US012337208B2

(12) United States Patent
McGregor et al.

(10) Patent No.: US 12,337,208 B2
(45) Date of Patent: Jun. 24, 2025

(54) NOISE ABATEMENT FOR FITNESS MACHINES

(71) Applicant: Life Fitness, LLC, Rosemont, IL (US)

(72) Inventors: Dylan McGregor, Bonfield, IL (US); Peter Kanakaris, Arlington Heights, IL (US)

(73) Assignee: Life Fitness, LLC, Rosemont, IL (US)

( * ) Notice: Subject to any disclaimer, the term of this patent is extended or adjusted under 35 U.S.C. 154(b) by 87 days.

(21) Appl. No.: 18/179,029

(22) Filed: Mar. 6, 2023

(65) Prior Publication Data

US 2023/0201655 A1 Jun. 29, 2023

Related U.S. Application Data

(63) Continuation-in-part of application No. 17/946,295, filed on Sep. 16, 2022, now Pat. No. 12,070,651, (Continued)

(51) Int. Cl.
*A63B 22/02* (2006.01)
*A63B 71/00* (2006.01)

(52) U.S. Cl.
CPC ..... *A63B 22/0228* (2015.10); *A63B 22/0214* (2015.10); *A63B 2071/0063* (2013.01); *A63B 2225/093* (2013.01)

(58) Field of Classification Search
CPC ..... A63B 22/02–0292; A63B 69/0028–0035; A63B 21/02–028
See application file for complete search history.

(56) References Cited

U.S. PATENT DOCUMENTS 5,279,528 A 1/1994 Dalebout et al.
5,336,144 A 8/1994 Rodden
(Continued)

FOREIGN PATENT DOCUMENTS

CN 1919380 A 2/2007
CN 201052372 Y 4/2008
(Continued)

OTHER PUBLICATIONS

European Search Report for corresponding European Application No. 21156302.8, dated Jul. 21, 2021.
(Continued)

*Primary Examiner* — Nyca T Nguyen
(74) *Attorney, Agent, or Firm* — Andrus Intellectual Property Law, LLP

(57) ABSTRACT

A fitness machine operable by a user. The fitness machine includes a base that extends in a length direction, a width direction, and a height direction that are perpendicular to each other. A mobile portion is configured to support the user during operation of the fitness machine. A resilient body is configured to provide a resistance against the mobile portion moving towards the base in the height direction. A frame is moveable in the length direction relative to the base to adjust the resistance provided by the resilient body. A fastener assembly moveably couples the frame to the base, where the fastener assembly is configured to expand in the width direction to prevent the frame from moving in the width direction relative to the base during operation of the fitness machine.

20 Claims, 15 Drawing Sheets

Related U.S. Application Data which is a continuation of application No. 17/167,184, filed on Feb. 4, 2021, now Pat. No. 11,458,356.

(60) Provisional application No. 62/976,871, filed on Feb. 14, 2020.

(56) References Cited

U.S. PATENT DOCUMENTS

| | | | | |
|---|---|---|---|---|
| 5,342,271 | A * | 8/1994 | Long | A63B 21/063 482/98 |
| 5,382,207 | A | 1/1995 | Skowronski et al. | |
| 5,827,155 | A | 10/1998 | Jensen et al. | |
| 5,993,358 | A | 11/1999 | Gureghian et al. | |
| 6,013,011 | A | 1/2000 | Moore et al. | |
| 6,053,848 | A | 4/2000 | Eschenbach | |
| 6,174,267 | B1 | 1/2001 | Dalebout et al. | |
| 6,174,268 | B1 | 1/2001 | Novak | |
| 6,280,362 | B1 | 8/2001 | Dalebout et al. | |
| 6,328,676 | B1 | 12/2001 | Alessandri | |
| 6,394,239 | B1 | 5/2002 | Carlson | |
| 6,436,008 | B1 | 8/2002 | Skowronski et al. | |
| 6,572,512 | B2 | 6/2003 | Anderson et al. | |
| 6,572,513 | B1 | 6/2003 | Whan-Tong | |
| 6,623,407 | B2 | 9/2003 | Novak et al. | |
| 6,652,424 | B2 | 11/2003 | Dalebout | |
| 6,738,482 | B1 | 5/2004 | Jaber | |
| 6,821,230 | B2 | 11/2004 | Dalebout et al. | |
| 6,893,383 | B1 * | 5/2005 | Chang | A63B 22/02 482/52 |
| 6,923,746 | B1 | 8/2005 | Skowroski et al. | |
| 6,945,913 | B2 | 9/2005 | Moore et al. | |
| 7,001,312 | B2 | 2/2006 | Alessandri et al. | |
| 7,077,788 | B2 | 7/2006 | Chang | |
| 7,163,493 | B1 | 1/2007 | Kuo | |
| 7,563,203 | B2 * | 7/2009 | Dalebout | A63B 22/0228 482/54 |
| 7,563,205 | B2 | 7/2009 | Alling | |
| 7,628,733 | B2 | 12/2009 | Donner et al. | |
| 7,976,437 | B1 | 7/2011 | Detten | |
| 8,012,068 | B1 | 9/2011 | Malcolm | |
| 8,118,888 | B2 | 2/2012 | Molter et al. | |
| 8,157,708 | B2 | 4/2012 | Daly et al. | |
| 8,454,480 | B2 | 6/2013 | Molter et al. | |
| 9,352,186 | B2 | 5/2016 | Watterson | |
| 9,814,929 | B2 | 11/2017 | Moser | |
| 10,589,146 | B2 | 3/2020 | Becker et al. | |
| 10,786,698 | B2 | 9/2020 | Endemann | |
| 11,458,356 | B2 | 10/2022 | Lu | |
| 2003/0045409 | A1 | 3/2003 | Herbest | |
| 2003/0139261 | A1 | 7/2003 | Kuo | |
| 2004/0102296 | A1 | 5/2004 | Dubrul | |
| 2004/0138030 | A1 | 7/2004 | Wang et al. | |
| 2004/0147372 | A1 | 7/2004 | Wang et al. | |
| 2005/0164839 | A1 | 7/2005 | Watterson et al. | |
| 2005/0250622 | A1 * | 11/2005 | Chang | A63B 22/02 482/54 |
| 2006/0287163 | A1 | 12/2006 | Wang | |
| 2007/0015635 | A1 * | 1/2007 | Donner | A63B 22/0228 482/54 |
| 2007/0015636 | A1 * | 1/2007 | Molter | A63B 22/02 482/54 |
| 2007/0225127 | A1 | 9/2007 | Pan et al. | |
| 2008/0006105 | A1 | 1/2008 | Ko | |
| 2008/0171640 | A1 | 7/2008 | Chang | |
| 2008/0176718 | A1 | 7/2008 | Wang | |
| 2008/0312047 | A1 | 12/2008 | Feng | |
| 2008/0318737 | A1 | 12/2008 | Chu | |
| 2009/0181829 | A1 | 7/2009 | Wu | |
| 2012/0129654 | A1 | 5/2012 | Wang | |
| 2012/0178590 | A1 | 7/2012 | Lu | |
| 2012/0270704 | A1 | 10/2012 | Wang | |
| 2013/0035214 | A1 | 2/2013 | Wang | |
| 2013/0053222 | A1 | 2/2013 | Lo | |
| 2013/0072364 | A1 | 3/2013 | Chen | |
| 2013/0123081 | A1 | 5/2013 | Boland | |
| 2013/0123082 | A1 | 5/2013 | Bashraheel | |
| 2013/0130868 | A1 | 5/2013 | Hou et al. | |
| 2013/0274071 | A1 | 10/2013 | Wang | |
| 2016/0279465 | A1 * | 9/2016 | Chang | A63B 22/02 |
| 2016/0287930 | A1 | 10/2016 | Moser | |
| 2018/0043207 | A1 | 2/2018 | Moser | |
| 2020/0188728 | A1 | 6/2020 | Ma | |

FOREIGN PATENT DOCUMENTS

| | | | |
|---|---|---|---|
| CN | 101310798 | A | 11/2008 |
| CN | 101468246 | A | 7/2009 |
| CN | 201949549 | U | 8/2011 |
| CN | 203060669 | U | 7/2013 |
| CN | 203564706 | U | 4/2014 |
| CN | 204233670 | U | 4/2015 |
| CN | 204261260 | U | 4/2015 |
| CN | 104623865 | A | 5/2015 |
| CN | 204563439 | U | 8/2015 |
| CN | 205198806 | U | 5/2016 |
| CN | 105797308 | A | 7/2016 |
| CN | 205516180 | U | 8/2016 |
| CN | 107456712 | B | 4/2019 |
| CN | 110393892 | A | 11/2019 |
| CN | 111729250 | A | 10/2020 |
| DE | 202006017300 | U1 | 4/2007 |
| EP | 1743677 | A1 | 1/2007 |
| EP | 2656881 | A1 | 10/2013 |
| KR | 200429306 | Y1 | 10/2006 |
| KR | 101221857 | B1 | 1/2013 |
| KR | 2015106131 | A | 9/2015 |
| TW | 200843813 | A | 11/2008 |
| WO | WO 2008099430 | A1 | 8/2008 |

OTHER PUBLICATIONS

Office Action from corresponding European Patent Application No. 21156302.8, dated Oct. 2, 2023.

* cited by examiner

NOISE ABATEMENT FOR FITNESS MACHINES

CROSS REFERENCE TO RELATED APPLICATIONS

This application is a continuation-in-part of U.S. patent application Ser. No. 17/946,295, filed Sep. 16, 2022, which is a continuation of U.S. patent application Ser. No. 17/167,184, filed Feb. 4, 2021, which claims the benefit of U.S. Provisional Patent Application No. 62/976,871, filed Feb. 14, 2020, all of which are incorporated herein by reference in its entirety.

FIELD

The present disclosure generally relates to fitness machines, and particularly to noise abatement for fitness machines.

BACKGROUND

The following U.S. patents provide background information and are incorporated herein by reference in entirety.

U.S. Pat. No. 8,118,888 discloses a method to support a deck of an exercise treadmill one or more arcuate leaf springs are used in a deck support structure. The leaf springs can be made of a single member of elastomeric material. An adjustment mechanism can be used to change the radius of the leaf springs to vary spring rates of the leaf springs. Where different leaf springs are used, the adjustment mechanism can be used to adjust the spring rates of different springs independently.

U.S. Pat. No. 5,382,207 discloses a method to improve tracking, whereby an exercise treadmill is provided with a frame including molded plastic pulleys, having an integral gear belt sprocket, an endless belt extending around the pulleys and a motor operatively connected to the rear pulley to drive the belt. The pulleys are molded out of plastic and have a diameter of approximately nine inches. A mold and method for producing large diameter treadmill pulleys having an integrally molded sprocket are also disclosed. A deck underneath the running surface of the belt is supported by resilient members. A positive lateral belt tracking mechanism is used to correct the lateral position of the belt. A belt position sensor mechanism is used in combination with a front pulley pivoting mechanism to maintain the belt in the desired lateral position on the pulleys. The exercise treadmill also includes a lift mechanism with an internally threaded sleeve engaged to vertically aligned nonrotating screws. A user display of foot impact force on the belt is also provided.

U.S. Pat. No. 7,628,733 discloses a method to provide variable resilient support for the deck of an exercise treadmill via one or more resilient members are secured to the deck and a moveable support member is used to selectively engage the resilient members to provide support for the deck. A user operated adjustment mechanism can be used to move the support member or support members longitudinally along the treadmill thus effectively changing the number of resilient support members supporting the deck.

U.S. Pat. No. 6,572,512 discloses an exercise treadmill which includes various features to enhance user operation and to reduce maintenance costs. Sound and vibration are reduced in a treadmill by mounting the treadmill belt drive motor on motor isolation mounts that include resilient members. A further feature is a double-sided waxed deck where one side of the deck is covered by a protective tape.

U.S. Pat. No. 6,783,482 discloses a microprocessor-based exercise treadmill control system which includes various features to enhance user operation. These features include programs operative to: permit a set of user controls to cause the treadmill to initially operate at predetermined speeds; permit the user to design custom workouts; permit the user to switch between workout programs while the treadmill is in operation; and perform an automatic cooldown program where the duration of the cooldown is a function of the duration of the workout or the user's heart rate. The features also include a stop program responsive to a detector for automatically stopping the treadmill when a user is no longer on the treadmill and a frame tag module attached to the treadmill frame having a non-volatile memory for storing treadmill configuration, and operational and maintenance data. Another included feature is the ability to display the amount of time a user spends in a heart rate zone.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure generally relates to a fitness machine operable by a user. The fitness machine includes a base that extends in a length direction, a width direction, and a height direction that are perpendicular to each other. A mobile portion is configured to support the user during operation of the fitness machine. A resilient body is configured to provide a resistance against the mobile portion moving towards the base in the height direction. A frame is moveable in the length direction relative to the base to adjust the resistance provided by the resilient body. A fastener assembly moveably couples the frame to the base, wherein the fastener assembly is configured to expand in the width direction to prevent the frame from moving in the width direction relative to the base during operation of the fitness machine.

In another aspect, the fastener assembly is also configured to prevent the frame from moving in the height direction relative to the base during operation of the fitness machine.

In another aspect, a bushing of the fastener assembly is configured to slide within a slot that extends in the length direction relative to the base when coupling the frame to the base such that the frame is moveable in the length direction. In a further aspect, the fastener assembly includes an expandable bushing that expands in the width direction within the slot to prevent the frame from moving in the width direction relative to the base. In a further aspect, the fastener assembly includes a plunger having a first angled face, wherein the expandable bushing has a second angled face corresponding to the first angled face of the plunger such that operative contact between the first angled face and the second angled face centers the plunger and the expandable bushing about an axis parallel to the height direction. In a further aspect, the slot extends through the frame.

In another aspect, the fastener assembly includes a plunger and a bushing, wherein the plunger has an angled face that when operatively contacting the bushing causes the bushing to move in the width direction to thereby cause the fastener assembly to expand in the width direction. In further aspect, the fastener assembly further comprises a biasing member that causes the plunger to operatively contact the bushing such that the fastener assembly expands in the width direction.

In another aspect, the frame is supported by the base.

In another aspect, the resilient body is supported by the frame and moveable therewith.

Another aspect according the present disclosure generally relates to a fitness machine operable by a user. The fitness machine includes a base that extends in a length direction, a width direction, and a height direction that are perpendicular to each other. A mobile portion is configured to support the user during operation of the fitness machine. A resilient body is configured to provide a resistance against the mobile portion moving towards the base in the height direction, where a body length of the resilient body changes in the length direction relative to the base when providing the resistance during operation of the fitness machine. A cushion operatively contacts the resilient body so as to reduce noise generated from contact with the resilient body during operation of the fitness machine.

In another aspect, the cushion is positioned between the resilient body and the mobile portion to reduce the noise generated from contact therebetween during operation of the fitness machine.

In another aspect, the cushion is coupled to the resilient body.

In another aspect, the resilient body comprises a first material, the cushion comprises a second material, and the resilient body and the cushion are integrally formed together. In a further aspect, the resilient body comprises urethane and the cushion comprises plastic.

In another aspect, the cushion comprises a synthetic web that covers at least a portion of the resilient body.

In another aspect, the fitness machine further includes an end stop operable to prevent the body length of the resilient body from increasing beyond a set maximum, the end stop being moveable to adjust the set maximum for the body length of the resilient body, where the cushion is positioned between the resilient body and the end stop to reduce the noise generated from contact therebetween during operation of the fitness machine. In a further aspect, the cushion comprises foam. In a further aspect, the cushion is a first cushion and the fitness machine further comprises a second cushion positioned between the resilient body and the mobile portion to reduce the noise generated from contact therebetween during operation of the fitness machine.

Another aspect according the present disclosure generally relates a fitness machine operable by a user. The fitness machine includes a base that extends in a length direction, a width direction, and a height direction that are perpendicular to each other. A mobile portion is configured to support the user during operation of the fitness machine. A resilient body is configured to provide a resistance against the mobile portion moving towards the base in the height direction, where a body length of the resilient body changes in the length direction relative to the base when providing the resistance during operation of the fitness machine. A cushion operatively contacts the resilient body so as to reduce noise generated from contact with the resilient body during operation of the fitness machine. A frame is moveable in the length direction relative to the base to adjust the resistance provided by the resilient body. A fastener assembly moveably couples the frame to the base, where the fastener assembly is configured to expand in the width direction to prevent the frame from moving in the width direction relative to the base during operation of the fitness machine.

It should be recognized that the different aspects described throughout this disclosure may be combined in different manners, including those than expressly disclosed in the provided examples, while still constituting an invention accord to the present disclosure.

Various other features, objects and advantages of the disclosure will be made apparent from the following description taken together with the drawings.

BRIEF DESCRIPTION OF THE DRAWINGS

The present disclosure is described with reference to the following drawing.

DETAILED DISCLOSURE

Figure 1:
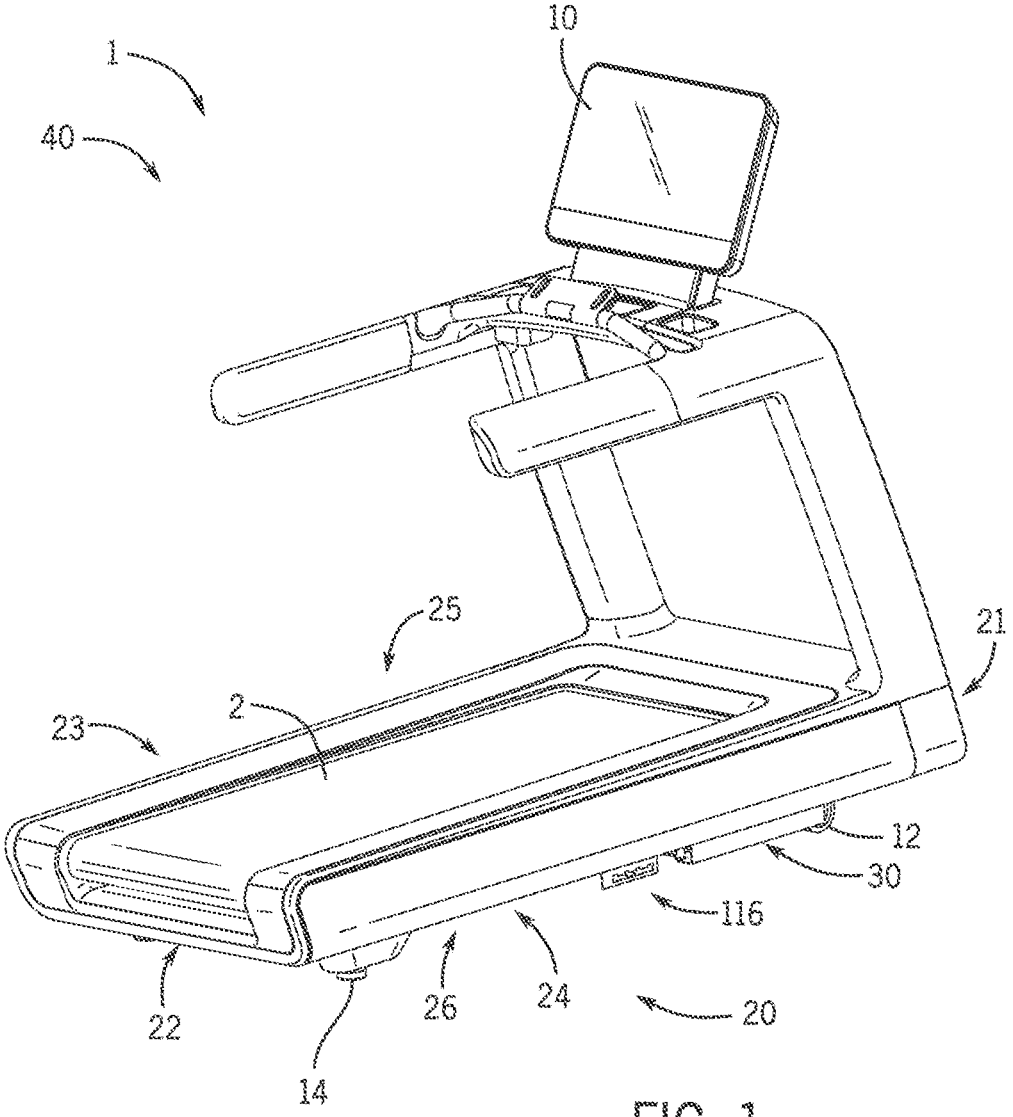
FIG. 1 is a rear perspective view of a fitness machine incorporating noise abatement according to the present disclosure.
Figure 2:
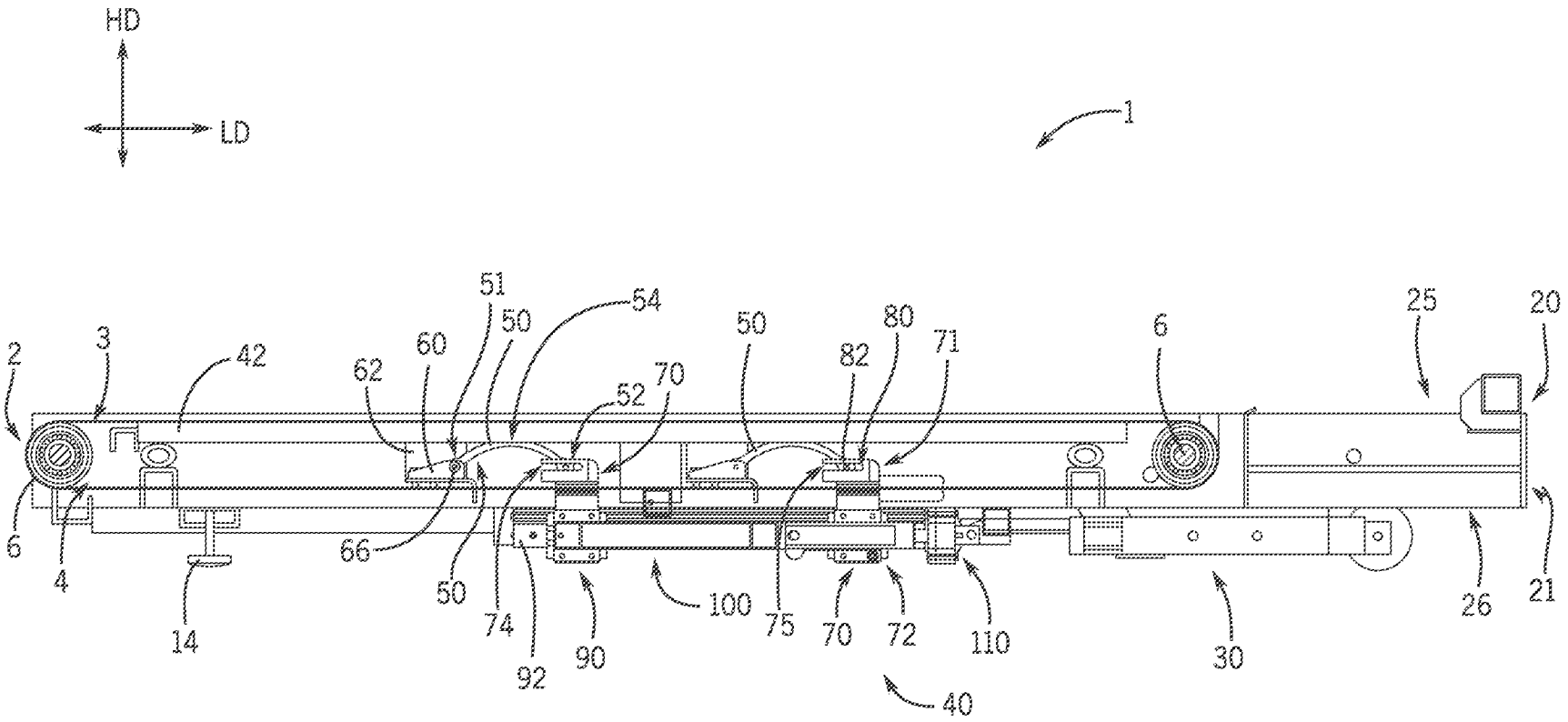
FIG. 2 is a side view of a lower portion of a fitness machine similar to that of FIG. 1 depicting an adjustable shock absorption system.

The present disclosure generally relates to systems and methods for providing noise abatement for fitness machines systems, including fitness machines having adjustable shock absorption. FIG. 1 depicts an exemplary embodiment of a fitness machine 1 incorporating an adjustable shock absorption system 40 according to the present disclosure. In the illustrated embodiment, the fitness machine 1 is a treadmill having a belt 2 that is rotated such that a user may run or walk on the belt 2. FIGS. 1 and 2 show the belt 2 having a running upper strand 3 and a returning lower strand 4 that continuously cycle about belt rollers 6 in a conventional manner. While the present disclosure principally discusses embodiments in which the fitness machine 1 is a treadmill having a motor that rotates the belt 2, it should be recognized that the present disclosure equally applies to treadmills in which forces by the user rotate the belt 2, as well as to fitness machines 1 other than treadmills (e.g., stair climbers).

The fitness machine 1 of FIGS. 1 and 2 is supported on a base 20 that extends in a length direction LD between a front 21 and rear 22, in a width direction (extending into the page) between a left 23 and right 24, and in a height direction HD between a top 25 and bottom 26. The length direction LD, the width direction, and the height direction HD are each parallel to each other. Operation of the fitness machine 1 is controlled by a console 10 in a manner known in the art, which for example controls the speed of the belt 2, an incline of the belt 2 relative to a horizontal plane (e.g., via a height adjustment system 30 in a manner known in the art), resistance levels (for example with bicycles, rowers, elliptical trainers, and/or treadmills in which the user rotates the belt), and/or other functions customary for operating fitness machines 1, as known in the art. The base 20 of the fitness machine 1 is supported on feet 14 and casters 12. As will be discussed below, manual controls 116 for adjusting the stiffness may be provided. The manual controls 116 may be moveable by the user in a manner similar to systems known in the art (e.g., here, selectable among 4 stiffness settings). However, as will become apparent, the presently disclosed systems and methods effectuate this stiffness adjustment in a completely different manner.

Fitness machines presently known in the art typically have a fixed or minimally adjustable "stiffness". In the case of treadmills, this may mean the stiffness of the running surface, for example. Even in fitness machines that do include some degree of adjustable stiffness (for example, the Life Fitness T5 Treadmill), existing systems do not provide a sufficient range of adjustability for the level of stiffness experienced by the user. Likewise, with systems presently known in the art, some users (e.g., light weight users) have a difficult time detecting changes in stiffness, for example between medium and soft settings. Additionally, some users of fitness machines require an especially "soft" stiffness, for example for ORANGETHEORY FITNESS® and other workout regimens. This is not accomplished by fitness machines that also provide a traditional stiffness, requiring dedicated equipment (and thus increasing the cost for a facility to offer such workout regimens). As such, there is an unmet need for a fitness machine that offers a full range of stiffness settings, for example from a stiffer setting corresponding to running on concrete down to a very-soft setting corresponding to sand, a gymnastics floor, or a pool springboard, for example.

Figure 3:
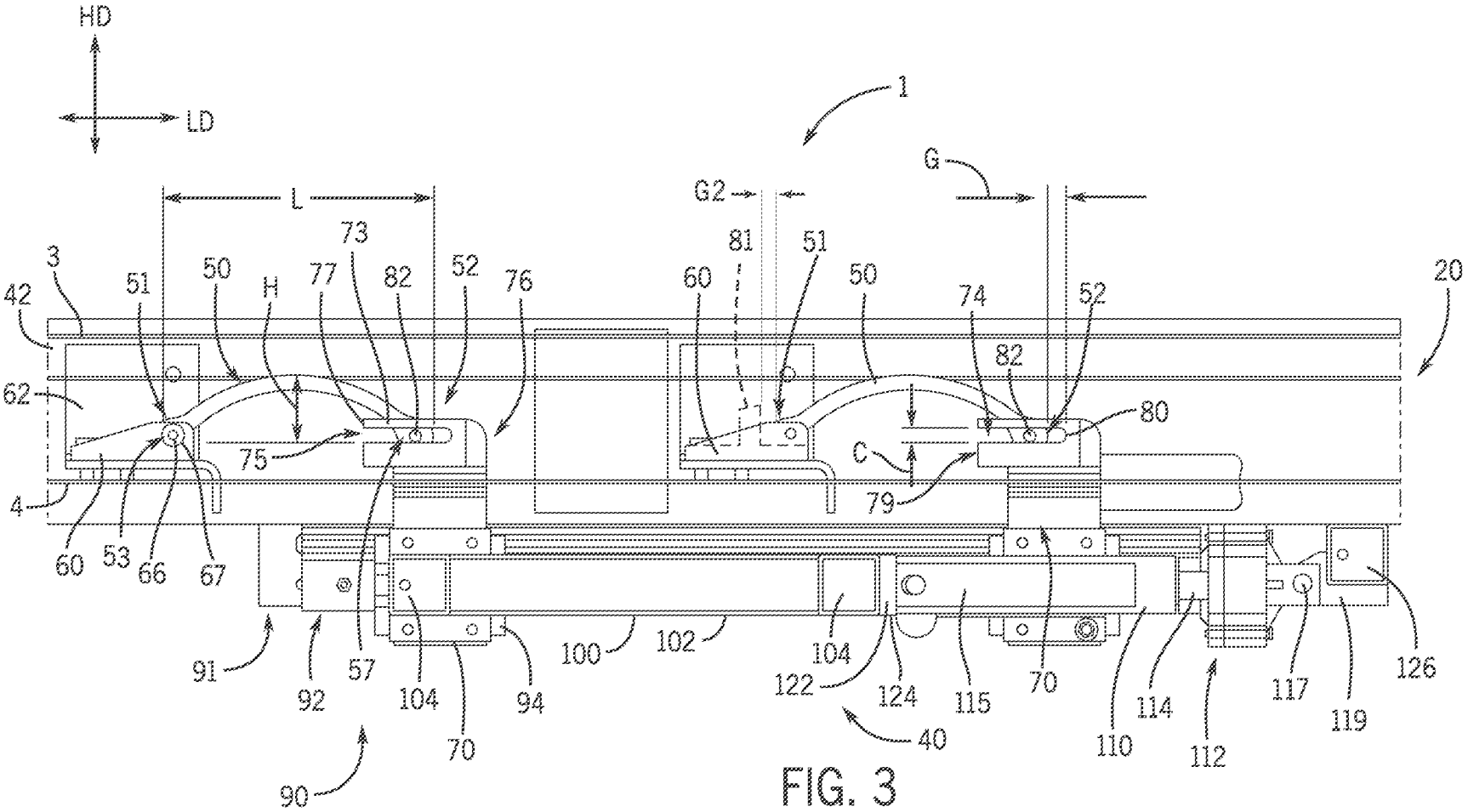
FIG. 3 is a close-up side view another fitness machine similar to that of FIG. 2.

FIGS. 2-3 depict two exemplary systems 40 for providing shock absorption according to the presently disclosure, and in these examples systems 40 in which the shock absorption is adjustable to provide a range of stiffness selections. In each example the fitness machine 1 includes a base 20 and a mobile portion 42 that is engageable by or otherwise supports the user, which consequently moves relative to the base 20 during operation of the fitness machine 1. The mobile portion 42 shown is a running deck that supports the belt 2 in a conventional manner, which moves up and down relative to the base 20 from the impact of the user running or walking thereon.

The system 40 include one or more resilient bodies, for example leaf springs 50, that resist movement of the mobile portion 42 towards the base 20, particularly in a height direction HD. In certain embodiments, the leaf spring 50 is made of an elastomeric material, such as rubber, polyurethane, and/or other polymers.

Figure 4:
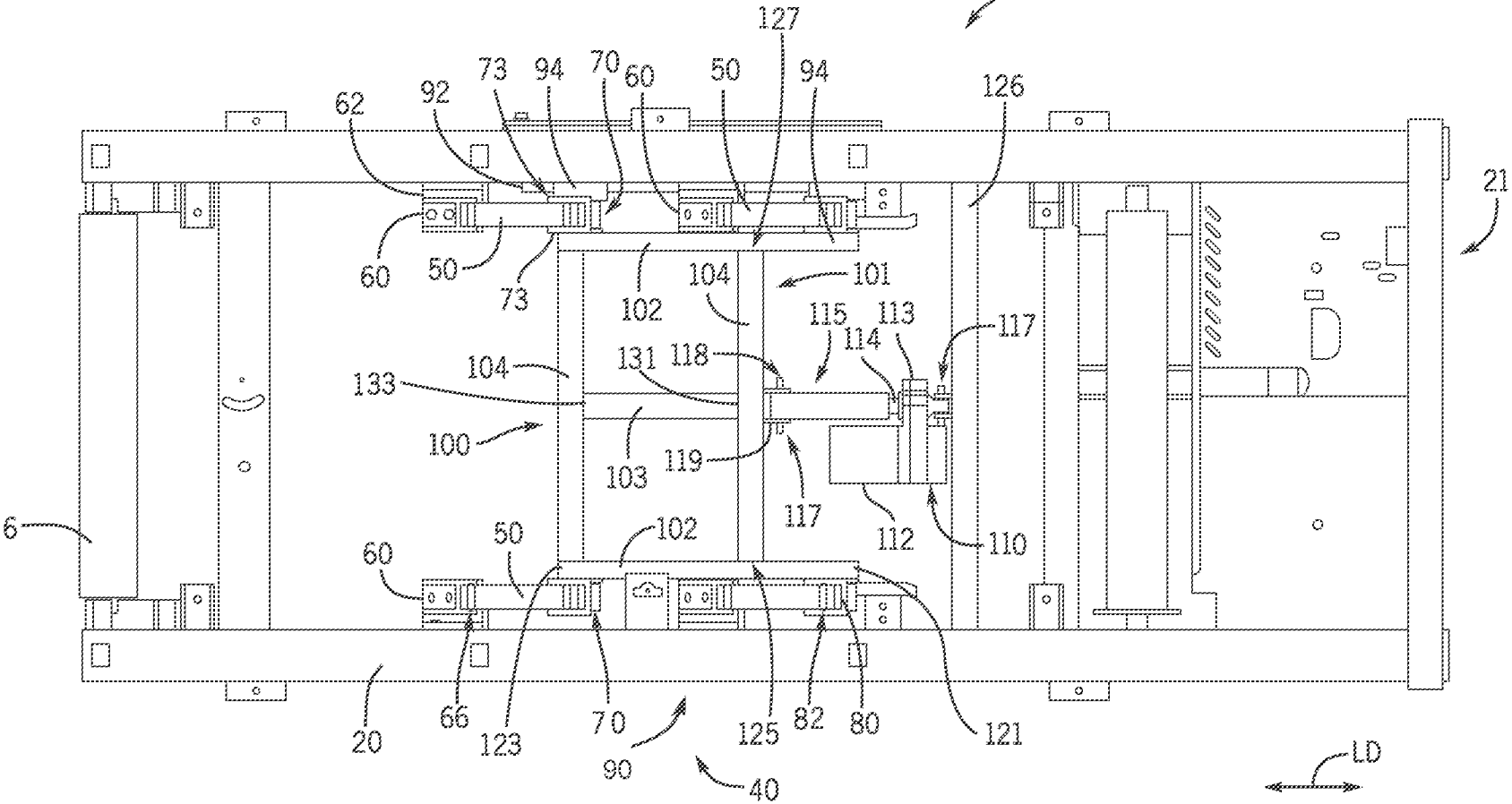
FIG. 4 is a top-down view of the lower portion of the fitness machine of FIG. 2.

The embodiments shown in FIGS. 2-4 each include four distinct and separate leaf springs 50 that work independently. These leaf springs 50 are each configured to function in the same or in a similar manner as the others. Thus, for simplicity, the leaf spring 50 and corresponding function are presently discussed singularly. Likewise, the leaf spring 50 described herein may be used in combination with one or more other shock absorbing devices presently known in the art.

Figure 7:
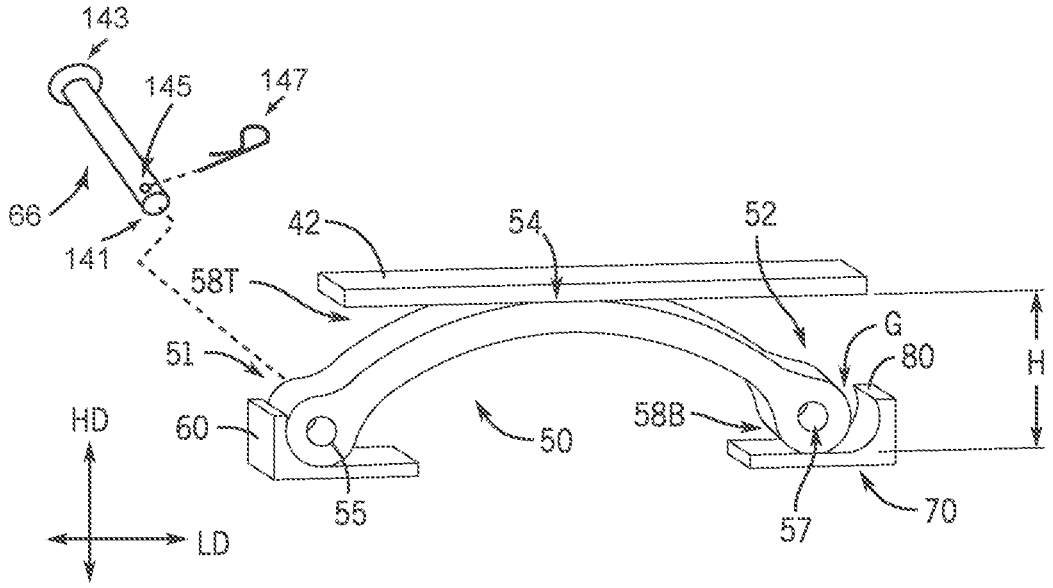
FIG. 7 is a perspective view of an exemplary resilient body such as may be incorporated within an adjustable shock absorbing system similar to that of FIG. 2.
Figure 8:
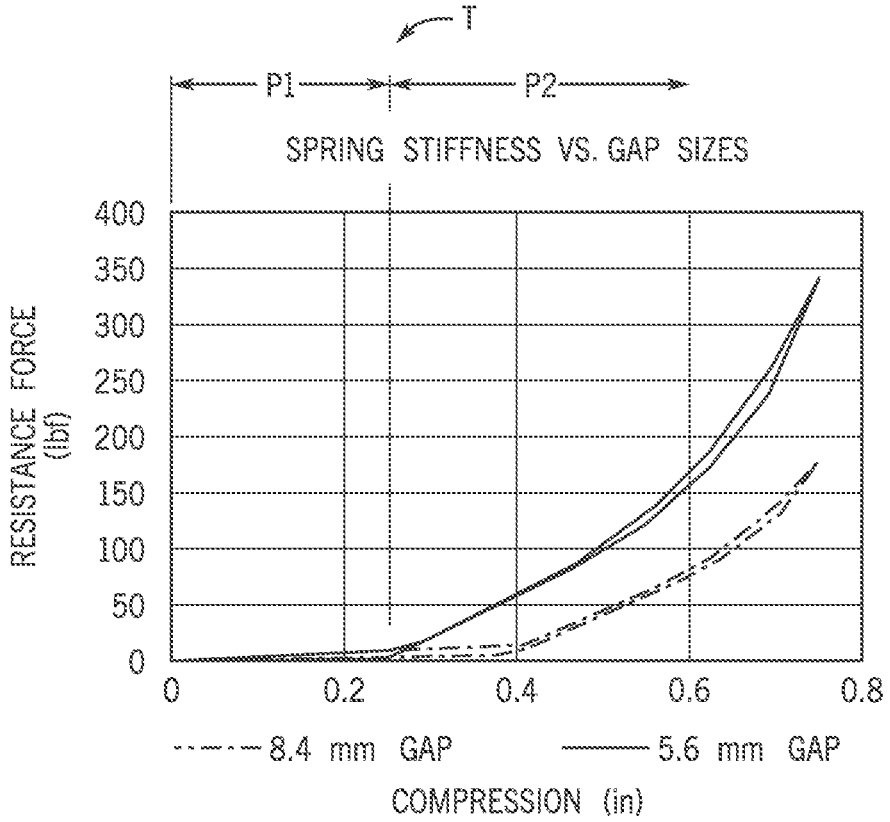
FIG. 8 depicts exemplary data for adjustable shock absorption systems according to the present disclosure, particularly the stiffness versus gap size between a resilient body and an end stop.

FIG. 7 depicts a close-up view an exemplary leaf spring 50 as incorporated within the system 40 of FIGS. 2-4. The leaf spring 50 is a resilient body that extends between a first end 51 and second end 52. A body length L is defined between the first end 51 and the second end 52 that when assembly within the fitness machine extends parallel to the length direction LD. The leaf spring 50 has a parabolic shape that opens downwardly and supports the mobile portion 42 at or near a vertex 54 of the parabolic shape. In the example shown, the mobile portion 42 rests on the leaf spring 50 without being coupled to the mobile portion 42.

A first pin hole 55 extends transversely through the leaf spring 50 at the first end 51, and in certain embodiments a second pin hole 57 also extends transversely through the leaf spring at the second end 52. The first pin hole 55 (and second pin hole 57 when present) are each configured to receive a pin such as first pin 66 therethrough, as discussed below. The first end 51 and second end 52 have a substantially circular side profile that is thicker in the height direction HD than the resilient body therebetween for added strength. The first pin hole 55 and second pin hole 57 each also have substantially circular side profiles that are approximately centered within the circular profiles of the first end 51 and the second end 52. However, this is merely an exemplary configuration for the leaf spring 50, which may be configured to have differing side profiles between the first end 51 and the second end 52 to alter the characteristics of the shock absorption provided by the leaf spring 50, for example.

Figure 5:
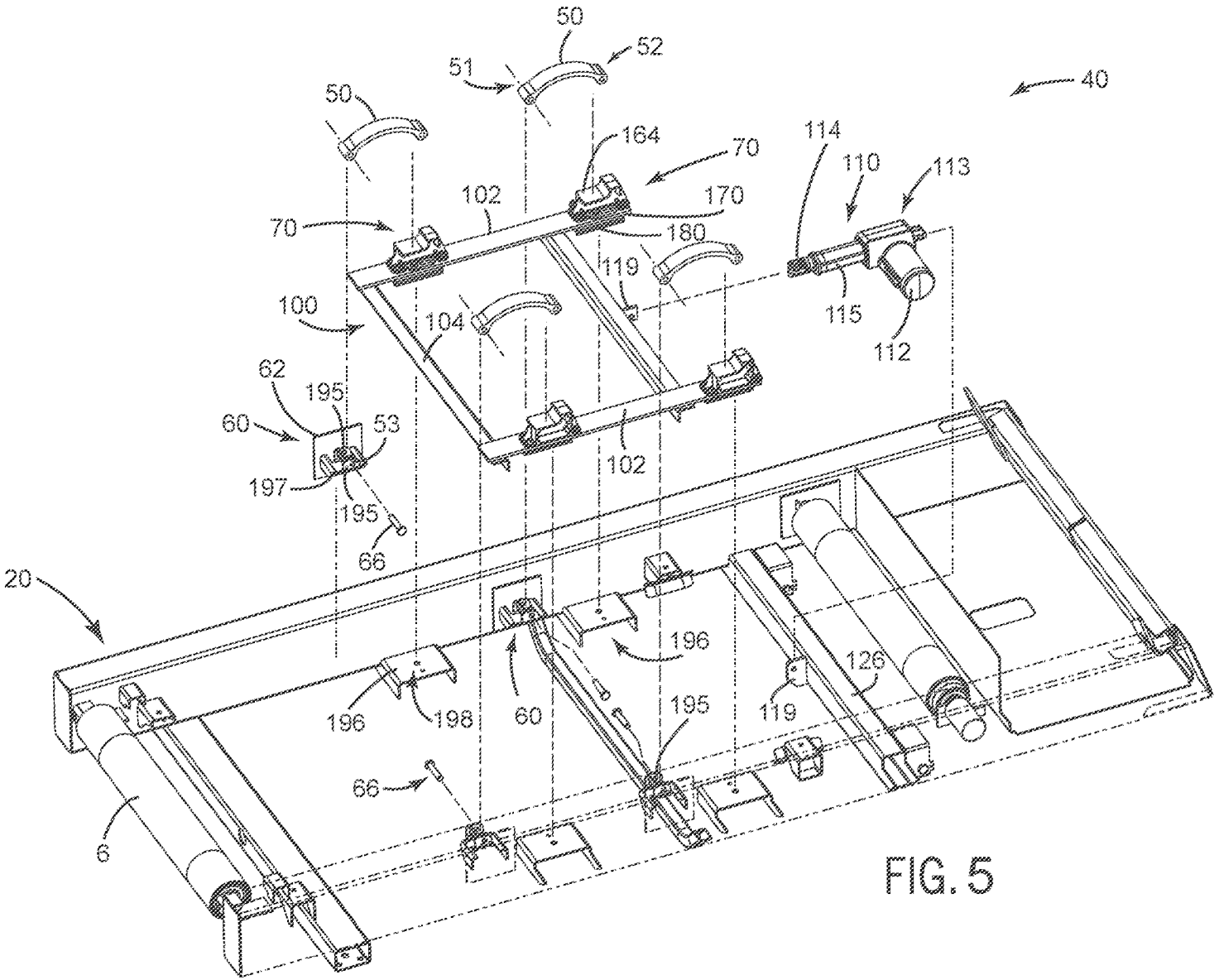
FIG. 5 is an exploded perspective view depicting an adjustable shock absorption system similar to that of FIG. 2.
Figure 6:
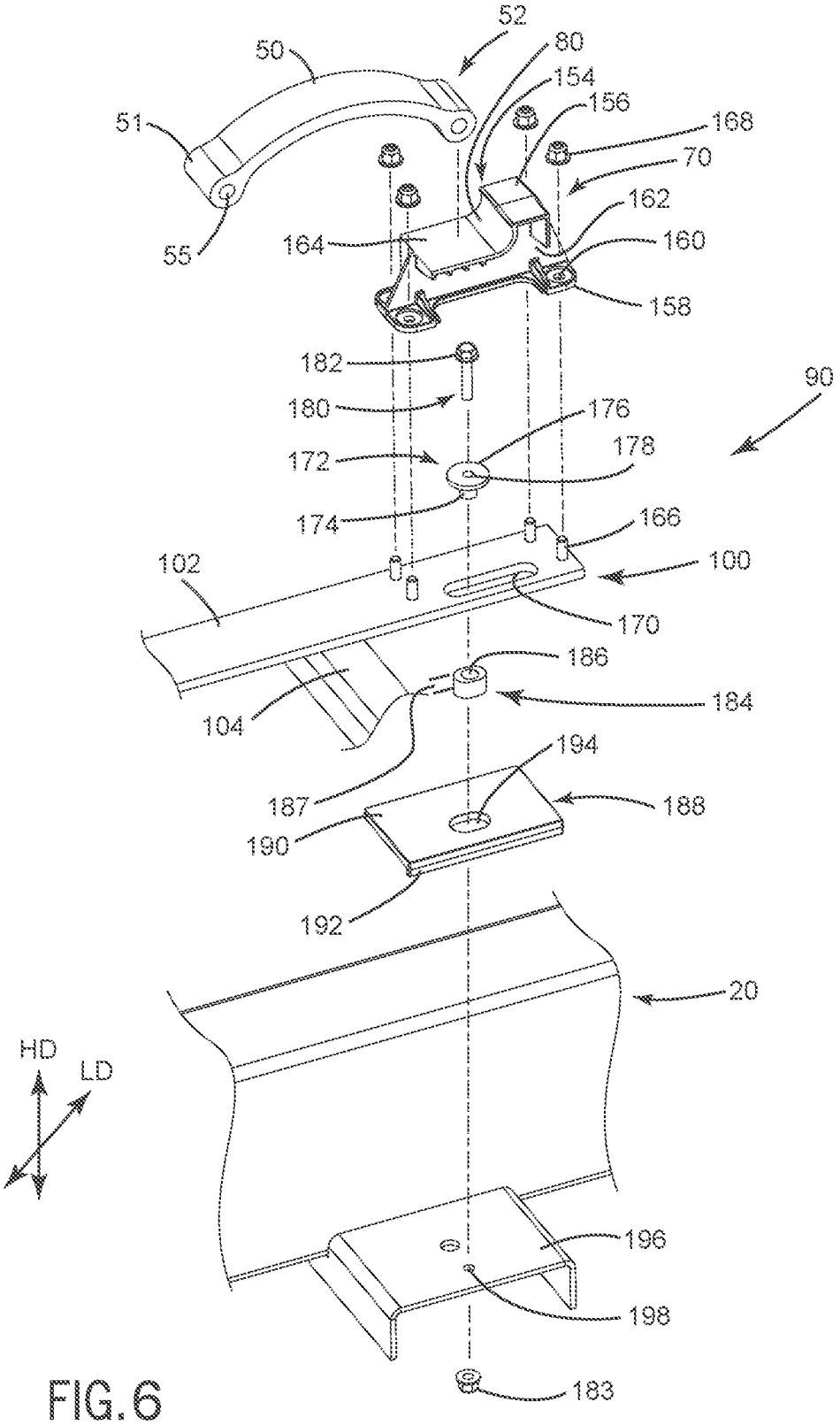
FIG. 6 is a close-up view depicting one embodiment of a fastener assembly for assembling a fitness machine such as that shown in FIG. 5.

FIGS. 3 and 5-6 depict how these leaf springs 50 may be coupled between the base 20 and the mobile portion 42, shown here for an adjustable shock absorption system 40 similar to that of FIG. 2. The first end 51 of the leaf spring 50 is pivotally coupled to the base 20 via a bracket 60. The bracket 60 includes a plate 62 with a bottom segment 197 extending perpendicularly away from the plate 62. The plate 62 is coupled to the inside of the base 20, for example via welding, fasteners (e.g., nuts and bolts), or other methods presently known in the art. Two ears 195 extend upwardly from the bottom segment 197 and are substantially parallel to the plate 62. A first pin hole 53 (FIG. 5) extends through each of the ears 195, the interiors of the first pin holes 53 being smooth or threaded depending on the type of a first pin 66 to be positioned therein. The first pin holes 53 are configured to receive a first pin 66, where the first pin 66 is also being received through the first pin hole 55 in the first end 51 of the leaf spring 50 to therefore pivotally couple the leaf spring 50 to the bracket 60.

Returning to FIG. 7, an exemplary first pin 66 is shown extending between a head 143 and tip 141 with a smooth shaft therebetween. An opening 145 is defined near the tip 141 for receiving a cotter pin 147 after the first pin 66 has been received through the bracket 60 (and through the first end 51 of the leaf spring 50). It should be recognized that the bracket 60 depicted in FIG. 7 is shown as only a partial view so as to not obscure the first pin hole 55, omitting the ears 195, for example. Other types of fasteners known in the art may also or alternatively be used as the first pin 66, including those with set screws, threads (e.g., engaging with a nut 67 as shown in FIG. 3), or press fits, those integrated with the leaf spring 50 (e.g., via over-molding), those welded to the bracket 60, and/or those used in conjunction with ears 195 of the bracket 60 that prevent lateral translation of the first pin 66, for example. These same examples for the first pin 66 also apply to a second pin 82 for the second end 52 of the leaf spring 50, which is discussed below.

In this manner, the leaf spring 50 is permitted to freely rotate about the first pin 66, but the first end 51 is prevented from translating in the length direction LD or in the height direction HD relative to the base 20.

As shown in FIGS. 5-6, the systems 40 further include end stops 70 that are fixable relative to the base 20, in the present embodiment in an adjustable manner. A separate end stop 70 is shown provided for each leaf spring 50 in a similar manner as the brackets 60. However, other configurations are also anticipated by the present disclosure. For simplicity, the end stops 70 are principally discussed singularly. In the embodiment of FIGS. 5-6, each end stop 70 extends from a top 156 to bottom 158 with a vertical segment 162 therebetween. Holes 160 are provided through the bottom 158 of the end stop 70 for mounting the end stop 70 to the base 20, specifically via a frame 100 to be discussed further below. The holes 160 receive threaded studs 166 that extend upwardly from the frame 100, in this example four threaded studs 166 for each end stop 70. Nuts 168 engage the threaded studs 166 to retain the end stops 70 on the frame 100. It should be recognized that other methods may be used for coupling the end stops 70 to the frame 100, including welding, other types of fasteners, and/or the like.

For each end stop 70, a floor 164 extends perpendicularly from the vertical segment 162, which intersects at a front end to a stop wall 80 connecting the floor 164 to the top 156. In the embodiment of FIGS. 5-6, the stop wall 80 is concaved such that a lip 154 extends rearwardly from the top 156 where the top 156 meets the stop wall 80. The contour of the stop wall 80 is configured in this manner to correspond with the contour of the second end 52 of the leaf spring 50, for example having a same approximate diameter. The second end 52 of the leaf spring 50 can thus slide forwardly along the floor 164 of the end stop 70 in the length direction LD until it engages the stop wall 80. The lip 154 that extends rearwardly from the top 156 is thus configured to prevent the second end 52 of the leaf spring 50 from moving upwardly in the height direction HD upon contacting the stop wall 80. It should be recognized that the lip 154 is not required and other forces such as the weight of the mobile portion 42 and the user also act to prevent movement of the second end 52 upwardly in the height direction HD.

Certain embodiments of systems 40 according to the present disclosure provide that the position each end stop 70 is adjustable in the length direction LD relative to the base 20, which as will become apparent provides adjustability of the stiffness for the fitness machine 1. As shown in FIGS. 3 and 7, a gap G exists between the second end 52 of the leaf spring 50 (or in certain embodiments discussed below, a second pin 82 extending therethrough) and the stop wall 80 of the end stop 70. This gap G is greater when the user is not generating any force on the mobile portion 42, for example when the user is mid-air while running on a treadmill. Since the stop wall 80 limits the forward translation of the second end 52 of the leaf spring 50, the gap G between the second end 52 and the stop wall 80 can be adjusted to modify the amount and/or characteristics of shock absorption being provided by the leaf spring 50.

The position of the stop wall 80 for an end stop 70 is adjustable by moving the support frame 100 to which the end stop 70 is coupled, as described above. As shown in FIGS. 4-5, the support frame 100 includes cross members 104 extending between a first end 125 and a second end 127 that run perpendicular to the length direction LD, as well as side members 102 extending between a first end 121 and second end 123 and a mid-support 103 extending between a first end 131 and second end 133 that all run parallel to the length direction LD. The cross members 104, side members 102, and mid-support 103 may vary in number from that shown and may be coupled together and/or integrally formed, for example. The end stops 70 are coupled to the support frame 100 such that when multiple leaf springs 50 are provided, one or more leaf springs 50 (and therefore the gaps G associated therewith) are adjustable together.

With reference to FIGS. 4-6, the support frame 100 is translatable relative to the base 20 in the length direction LD via engagement within a track system 90. In this embodiment, support beams 196 extend inwardly from the base 20, each of which having an opening 198 in the height direction HD. A base 188 rests on the top of the support beam 196. In the example shown, the base 188 includes a plate 190 that rests on the top of the support beam 196, and wall 192 extending perpendicularly downwardly from the plate 190. The wall 192 engages with an inside edge of the support beam 196 to prevent rotation of the base 188 relative to the support beam 196.

An elongated hole 194 is provided through the plate 190 of base 188. An elongated standoff 184 having an exterior shape substantially matching the interior shape of the elongated hole 194 is received in part within the elongated hole 194. A hole 186 is defined through the elongated standoff 184 in the height direction HD, which in the present example has a circular cross section. As shown in FIG. 6, the elongated standoff 184 is also received in part within a slot 170 defined within the support frame 100, specifically through the side members 102 in close proximity to the mounting location of each end stop 70. The exterior shape of the elongated standoff 184 is also configured to have a width 187 corresponding to a width of the slot 170 in the support frame 100. In the example shown, a top of the elongated standoff 184 is substantially flush with a top for the side member 102 of the support frame 100 when assembled.

A flanged coupler 172 has a flange top 176 with a barrel 174 extending downwardly therefrom. A hole 178 is defined through the flanged coupler 172. The barrel 174 is configured to have an outer diameter corresponding to the interior diameter of the hole 186 in the elongated standoff 184 such that the barrel 174 is received therein. When assembled, the underside of the flange top 176 is approximately flush with the top of the side member 102, preventing movement in the height direction HD. A fastener 180 (e.g., a bolt) having a head 182 is received through the flanged coupler 172, the elongated standoff 184, the base 188, and the opening 198 in the support beam 196 and threadingly engages a nut 183 on the opposite side of the support beam 196. It should be recognized that alternate methods of fastening known in the art may also be used. Once coupled together in this manner, the support frame 100 is moveable in the length direction LD relative to the base 20 by the elongated standoff 184 sliding within the slot 170, but prevented from rotating (i.e., due to like-engagement between the support frame 100 and other support beams 196 of the base 20), moving transversely, or moving in the height direction HD.

It should be recognized the present disclosure also anticipates embodiments in which there are multiple, separate support frames 100 for changing the positions of one or more leaf spring 50 separately from other leaf springs 50. For example, leaf springs 50 could be adjusted independently, all together, or in subgroups. In certain embodiments, two support frames 100 may be provided to enable separate adjustment between front and rear pairs of leaf springs 50. This separation of adjustability enables one set of leaf springs 50 to travel a greater distance than another set of leaf springs 50, for example.

The support frame 100 and particularly its position in the length direction LD may be moved and locked in place using various forms of hardware known in the art. For example, a manual adjustment mechanism may be provided, such as a threaded hand crank or fasteners coupling the support frame 100 to discrete openings within the base 20 (e.g., the manual controls 116 of FIG. 1 in a manner known in the art). Alternatively, cam locks as presently known in the art may be used to lock the support frame 100 to the base 20 once in the desired position, for example. The locking hardware may be electrically actuated, including electrically actuated cams.

With reference to FIG. 3-5, the support frame 100 is moveable via an actuator 110, which may be operated via electrical momentary switches, a control system 200 as discussed below (including via the console 10), or other methods known in the art. The actuator may be an electrical, pneumatic, and/or hydraulically actuator known in the art. For example, a mechanism similar to a conventional height adjustment mechanism 30 (see FIG. 1) for a treadmill could be employed to move the support frame 100. One such commercially available height adjustment mechanism is Treadmill incline motor lift actuator 0K65-01192-0002/CMC-778, produced by P-Tech USA. The actuator 110 may also itself provide the locking function for the positioning of the support frame 100.

The actuator 110 is coupled between the base 20 and a front end 101 of the support frame 100 to translate the support frame 100 relative to the base 20 in the length direction LD. Specifically, a first end of the actuator 110 is coupled to a cross member 126 of the base 20 with brackets 119 and fasteners 117, such as bolts, pins, and/or the like. An opposite end of the actuator 110 is coupled to the support frame 100, also via a bracket 119 and fastener 117 in a conventional manner, which may be the same bracket 119 and/or fastener 117 provided between the actuator 110 and the cross member 126 as described above. It should be recognized that the actuator 110 may be coupled between the base 20 and support frame 100 in alternate positions as well. Likewise, other types of actuators 110, including scissor-type actuators, rack and pinion actuators, and/or other configurations known in the art may also be used.

The exemplary actuator 110 of FIGS. 4-5 includes a motor 112 that rotatably engages with a gearbox 113. Rotation of the motor 112 extends or retracts a rod 114 relative to a housing 115 of the gearbox 113 in the length direction LD. Specifically, rotation of the motor 112 in a first direction causes rotation of the rod 114 through the gearbox 113, where a threaded engagement between the outer diameter of the rod 114 and the interior of the housing 115 causes the rod 114 to extend or retract in the length direction LD relative to the housing 115 as the motor 112 rotates. In contrast, rotation of the motor 112 in an opposite direction causes retraction of the rod 114 in the opposite manner. It should be recognized that either the rod 114 or the housing 115 may be coupled to the support frame 100 (with the other to the base 20), depending on the configuration of the actuator 110. In this manner, operating the actuator 110 causes movement of the support frame 100 relative to the base 20. This movement of the support frame 100 consequently adjusts the gap G between the leaf springs 50 and the stop walls 80 of the corresponding end stops 70, as discussed above. In the example shown, all leaf springs 50 are adjusted simultaneously and equivalently (i.e., a same distance in the length direction LD).

With reference to FIGS. 3-4, it should be recognized that the body length L between the first end 51 and the second end 52 of the leaf spring 50 is caused to increase when the mobile portion 42 moves towards the base 20 during operation of the fitness machine 1. In other words, the parabolic shape of the leaf spring 50 is caused to flatten during use. However, the body length L of the leaf spring 50 may be constrained by engagement between the second end 52 and the stop wall 80 of the end stop 70. Once the body length L can no longer increase, the leaf spring 50 may further resist movement of the mobile portion 42 towards the base 20, but now through a different mechanism, namely, compression of its resilient material. Therefore, adjusting the gap G between the leaf spring 50 and the stop wall 80 of the end stop 70 adjusts the allowable body length L of the leaf spring 50, and thus the profile of resistance provided by the system 40, which consequently adjusts the stiffness of the fitness machine 1.

The resistance provided by the system 40 varies depending upon whether the second end 52 of the leaf spring 50 is engaging the stop wall 80, creating two or more distinct phases. In an initial phase referred to as first phase P1 (discussed further below and shown in FIG. 6), the resistance provided by the leaf spring 50 against movement between the mobile portion 42 and the base 20 is primarily provided via bending deformation of the leaf spring 50. In other words, the body length L of the leaf spring 50 may change, increasing as the mobile portion 42 moves towards the base 20. However, once the second end 52 engages with the stop wall 80 of the end stop 70 (or second pin 82 extending therethough for an embodiment discussed further below), which is been fixed relative to the base 20, a second phase P2 begins in which a body length L of the leaf spring 50 can no longer change. At this stage, further movement of the mobile portion 42 towards the base 20 is resisted by the leaf spring 50 primarily by compressing the leaf spring 50, rather than by bending the leaf spring 50 as provide during phase 1 P1. In other words, the parabolic shape can no longer get wider longer, and thus the leaf spring 50 starts to compress. In certain embodiments, the term "primarily" with respect to the basis for resistance means the basis has a greater contribution than any other basis (i.e., bending contributing to the resistance more than compressing contributes to the resistance). In certain embodiments, the basis having the greatest contribution provides more than 50% of the total resistance. In certain configurations, approximately 50%, 70%, 80%, 90%, 95%, or other portions of the stiffness is provided in phase 2 P2.

As shown in FIGS. 8 and 9A-9D, the resistance provided by the leaf spring 50, also referred to as spring stiffness, is thereby provided as a function of whether the resistance is in phase one P1 or phase two P2. Likewise, the selection of when a transition T from phase one P1 to phase two P2 occurs (i.e., the position of the mobile portion 42 relative to the base 20) is based upon the gap G provided between the second end 52 of the leaf spring 50 and the stop wall 80. In certain embodiments, the leaf spring 50 is selected such that the resistance provided in phase one P1 is substantially lower than the resistance provided in phase two P2. For example, in certain cases the spring stiffness in phase one P1 is no more than 50 percent of the spring stiffness in phase two P2. In further examples, the spring stiffness in phase one P1 is no more than 10 percent of the spring stiffness in phase two P2, or one order lower.

It should be recognized that while the present disclosure generally refers to the leaf spring 50 providing a resistance in each of the phases, here phase one P1 and phase two P2, the resistance may also be considered a resistance profile. For example, the resistance need not be constant, nor linear within a given phase (such as in phase two P2 of FIG. 8). It should also be recognized that the larger the gap G between the second end 52 of the leaf spring 50 and the stop wall 80, the greater the deflection of the mobile portion 42 relative to the base 20 before phase 2 P2 is entered. In other words, a larger gap G provides for more deflection within the softer stiffness of phase one P1. As discussed above, the systems 40 and methods presently disclosed allow the user to fully configure the stiffness of the shock absorption for the fitness machine 1, and specifically when this greater resistance of phase two P2 is felt by the user.

It should be recognized that additional phases may also be provided by the system 40 according to the present disclosure. For example, instead of pivotally fixing the first end 51 of the leaf springs 50 to the bracket 60, the first end 51 may also be translatable in the length direction LD in a similar or same manner as the second end 52. An example of this configuration is shown in FIG. 3, specifically for the forward-most bracket 60 shown. A stop wall 81 is integral with or coupled to the bracket 60, which provides a limit for the first end 51 of the leaf spring 50 moving rearwardly. The stop wall 81 thus prevents translation of the first end 51 of the leaf spring 50 without the use of a first pin 66. Other features may also be included to restrict movement of the first end 51 in the height direction HD, for example, such as the slot 74 discussed for the end stop 70 discussed above. In this embodiment, the first end 51 has a gap G2 of travel before being constrained by stop wall 81, thereby changing the overall resistance profile for the system 40 relative to the pivoting embodiment of the rear-most bracket 60 shown. Additional phases or impacts to the overall resistance profile may be provided by controlling one or more leaf springs 50 separately from others, such as having a gap G (and/or gap G2) that is greater for rear leaf springs 50 relative to forward leaf springs 50, for example.

It will also be understood that the leaf spring 50 need not be shaped as shown in the figures, which may also or alternatively vary in number and/or position relative to the base 20 and mobile portion 42 of the fitness machine 1. The positions of the leaf springs 50 relative to the base 20 may also be adjustable in ways other than adjusting the gap G between the leaf spring 50 and the stop wall 80 (and/or gap G2 for stop wall 81). Similarly, the end stops 70 may be adjustable in the height direction HD in addition to, or in the alternative to in the length direction LD, further modifying the manner in which the adjustments change the resistance profiles of the leaf springs 50.

Additional testing results for a fitness machine 1 and system 40 as shown in FIGS. 2-4 are provided in FIGS. 9A-9D, which were tested on a hydraulic MTS® test system in which the leaf springs 50 were compressed for 0.45 inches in the height direction HD in 2 Hz and 5 Hz sinusoidal motion-controlled mode. In the plots, the horizontal axes represent the amount of compression (the same for the four plots), while the vertical axes represent the applied forces to reach the corresponding deformations. The scale of the vertical axes is kip, or 1000 lbf.

Figure 9A:
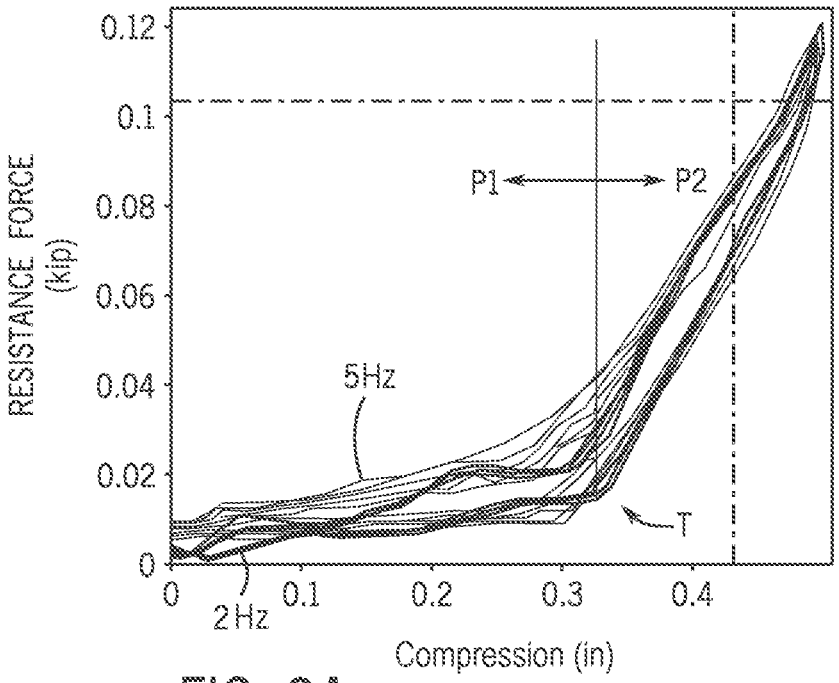
FIGS. 9A-9D depict further exemplary data for testing adjustable shock absorption systems according to the present disclosure.
Figure 9B:
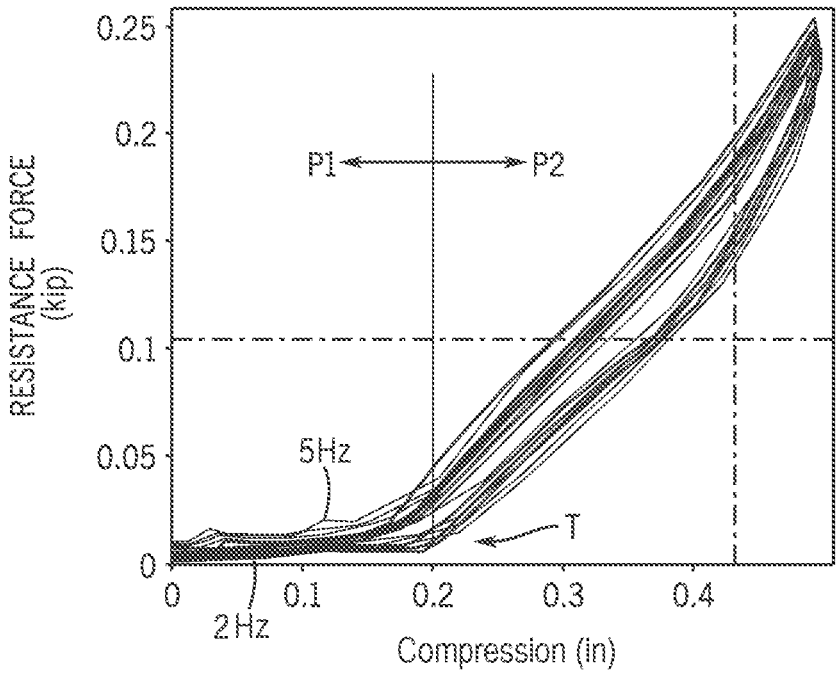
Figure 9C:
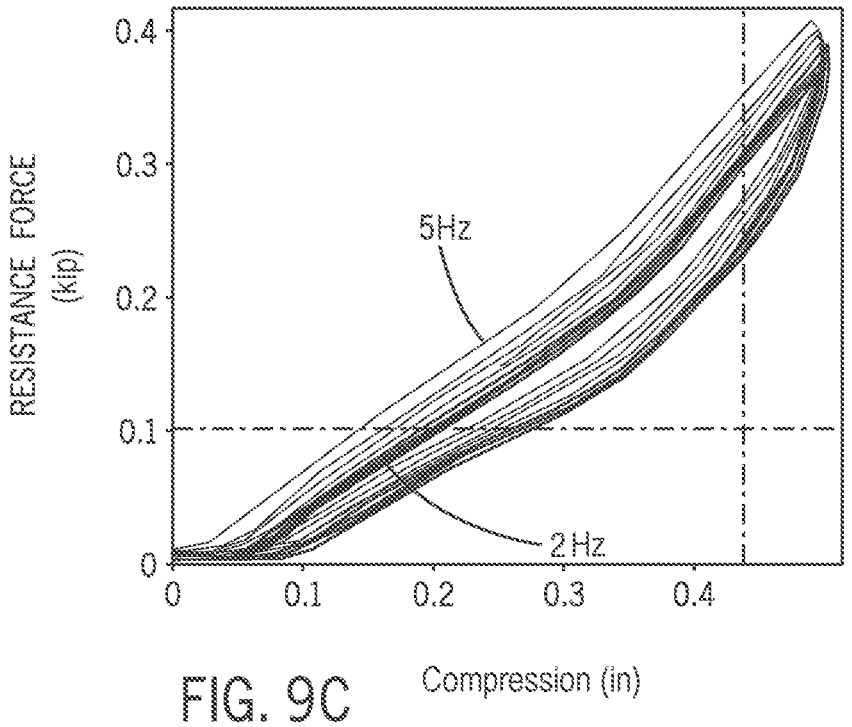
Figure 9D:
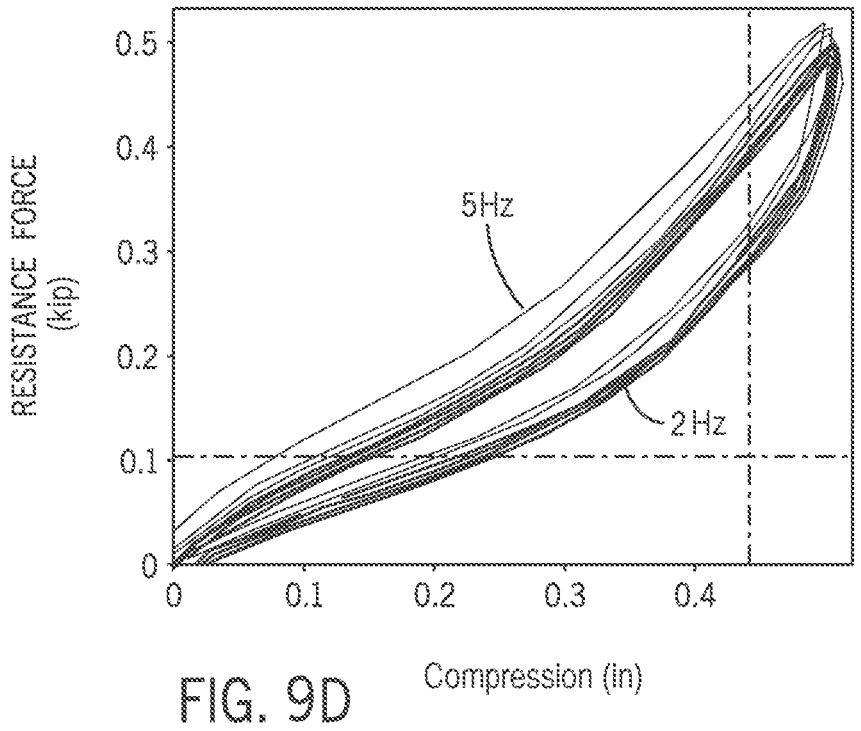

The curves demonstrate that there was little difference between responses under the two tested frequencies. FIG. 9D depicts the results when the leaf spring 50 was constrained at the original body length L (no gap G to the stop wall 80), whereby the resultant force reached about 500 lbf at 0.45 inch vertical travel. FIG. 9C was tested with 25% gap G (the percentage compared to the maximum gap, or equivalently the gap G needed to let the leaf spring 50 free bend into a straight beam. In this case, 25% was about 2.8 mm, where the peak loading reached about 400 lbf. FIG. 9B was tested at 50% gap G (about 5.6 mm), where about 250 lbf was needed to compress the spring down by 0.45 inch. FIG. 9A was tested at 75% gap G, with maximum force of about 120 lbf. Collectively these results demonstrate how the stiffness of the fitness machine 1 can be effectively controlled using the system 40 presently disclosed.

FIGS. 2-3 depict an alternative configuration for an end stop 70, which may be used alone or in conjunction with the end stop 70 discussed above for the system 40 of FIGS. 5-6. In this embodiment, the stop wall 80 is formed at the end or termination of a slot 74 defined within the sides of the end stop 70. Specifically, the end stop 70 has a top 71 with two arms 73 that extend rearwardly from a front 76 to fingertips 77. In the example shown, the fingertips 77 extend from the front 76 of the end stop 70 approximately the same distance as do base tips 79 such that a slot 74 is formed between the fingertip 77 and base tip 79 on each side of the end stop 70. As shown in the top-down review of FIG. 4, providing two arms 73 for each end stop 70 allows the leaf spring 50 to be positioned between the arms 73, which retains the leaf spring 50 in position relative to the left 23 and right 24 of the fitness machine 1.

This embodiment of end stop 70 is configured such that a second pin 82 extending through the second pin hole 57 in the second end 52 of the leaf spring 50 is translatable in the length direction LD within the slot 74. The second pin 82 is insertable into the slot 74 at least via the open end 75 opposite a stop wall 80 and front 76. The clearance C of the slot 74 is selected based on the diameter of the second pin 82 such that no movement is permitted in the height direction HD. Forward translation of the second end 52 of the leaf spring 50 may thus be prevented by engagement between the stop wall 80 and the second pin 82 extending through the second end 52, and/or engagement between the stop wall 80 and the second end 52 itself.

With continued reference to FIGS. 2-3, the second pin 82 may be the same or similar to the first pin 66, or be formed of other hardware known in the art. In certain examples, the second pin 82 and/or first pin 66 are rods retained in place via cotter pins and/or the like. In another example, the second pin 82 and/or first pin 66 are over-molded to be retained on the leaf spring 50 to extend outwardly therefrom, for example. Whether or not first pins 66 and/or second pins 82 are used, the leaf spring 50 may also or alternatively be coupled to the mobile portion 42, for example at the vertex 54.

The present disclosure also anticipates differing configurations for the support frame 100 being translatably moveable relative to the base 20 in the length direction LD. FIG. 3 depicts an embodiment of a system 40 providing this adjustment via engagement via a different track system 90 than discussed above. This track system 90 includes a sliding track 92 that is coupled to the base 20 via track mounts 91. Specifically, a track riding bracket 94 is coupled to the support frame 100, for example on the side members 102. The track riding bracket 94 slideably engages with the sliding track 92, which may function similarly to a conventional drawer slide having roller bearings, incorporate a rack and pinion engagement, and/or other sliding mechanisms known in the art. The support frame 100 may then be locked relative to the base 20 in a manner known in the art and as discussed above.

Figure 10:
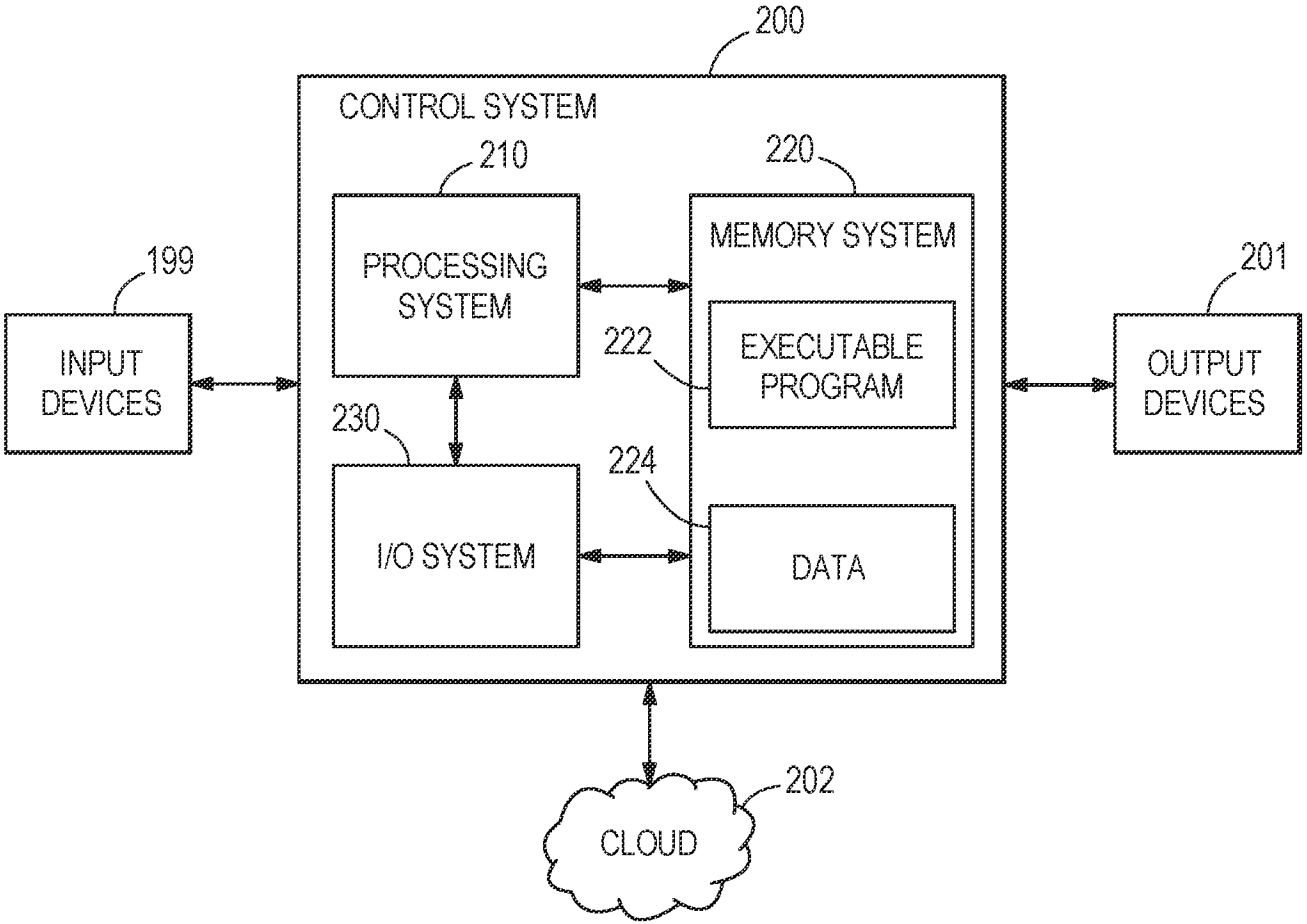
FIG. 10 depicts an exemplary control system for operating adjustable shock absorption systems according to the present disclosure.

Certain embodiments of system 40 for adjusting the stiffness of fitness machine 1 incorporate the use of a control system 200. FIG. 10 depicts an exemplary control system 200 for adjusting the stiffness for a fitness machine 1, which may be manually operated by the user and/or automatically selected or modified according to a given program controlled by the console 10. The control system 200 in certain embodiments automatically modifies the stiffness according to a changing program or other factors such as user's body weight or fitness levels. For example, the stiffness may be automatically modified when a program for the fitness machine 1, such as a treadmill, transitions from simulating running on a trail versus running on a road (here, transitioning from soft to firm stiffnesses), for example.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, such as shown in FIG. 10, the control system 200 communicates with each of the one or more components of the system 40 via a communication link CL, which can be any wired or wireless link. The control system 200 is capable of receiving information and/or controlling one or more operational characteristics of the system 40 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the fitness machine 1. Moreover, the communication link CL lines are meant only to demonstrate that the various control elements are capable of communicating with one another, and do not represent actual wiring connections between the various elements, nor do they represent the only paths of communication between the elements. Additionally, the system 40 may incorporate various types of communication devices and systems, and thus the illustrated communication links CL may in fact represent various different types of wireless and/or wired data communication systems.

The control system 200 may be a computing system that includes a processing system 210, memory system 220, and input/output (I/O) system 130 for communicating with other devices, such as input devices 199 and output devices 201, either of which may also or alternatively be stored in a cloud 202. The processing system 210 loads and executes an executable program 222 from the memory system 220, accesses data 224 stored within the memory system 220, and directs the system 40 to operate as described in further detail below.

The processing system 210 may be implemented as a single microprocessor or other circuitry, or be distributed across multiple processing devices or sub-systems that cooperate to execute the executable program 222 from the memory system 220. Non-limiting examples of the processing system include general purpose central processing units, application specific processors, and logic devices.

The memory system 220 may comprise any storage media readable by the processing system 210 and capable of storing the executable program 222 and/or data 224. The memory system 220 may be implemented as a single storage device, or be distributed across multiple storage devices or sub-systems that cooperate to store computer readable instructions, data structures, program modules, or other data. The memory system 220 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an The present inventors have recognized that some fitness machines known in the art make noises during operation, and particularly noises corresponding to the user's use of the fitness machine. By way of example, these noises may be caused by the user running on the deck of a treadmill. This is in contrast to the sound of a motor running, for example rotate a belt for a treadmill or steps for a stairclimbing fitness machine, or the sounds of the belt and steps consequently moving. Through experimentation and development, the present inventors have identified multiple causes for the noises generated during use of the fitness machine, which each arise from contact between a shock absorption system and other moving or stationary portions of the fitness machine. The fitness machine 1 of FIG. 2 is referenced to describe components of an example of a fitness machine having a shock absorption system 40. However, it should be recognized that the sources of noises discussed herein may arise in other embodiments of fitness machines, including but not limited to fitness machines other than treadmills and fitness machines not having shock absorption systems. Moreover, while the following description will principally refer to a leaf spring 50 within systems for providing shock absorption, it should be recognized that the teachings apply to resilient bodies more generally.

In a first case, the present inventors have discovered that some noises are generated by unintended relative movement between elements of the fitness machine, such as movement between the base 20, the frame 100 supporting the leaf spring 50, the leaf spring 50, the mobile portion 42 (e.g., a treadmill deck), and/or the end stop 70 that engages the leaf spring 50. As discussed above, the frame 100 is moveable in the length direction LD to adjust the amount of shock absorption provided by the leaf spring 50. However, the present inventors have discovered that any movement in the width direction WD, such as from part to part variation due to tolerances or wear, causes undesirable noises as the user operates the fitness machine. As such, the present inventors have developed an alternative mechanism for coupling the frame 100 and the base 20 so as to prevent these noises during operation of the fitness machine.

Figure 11:
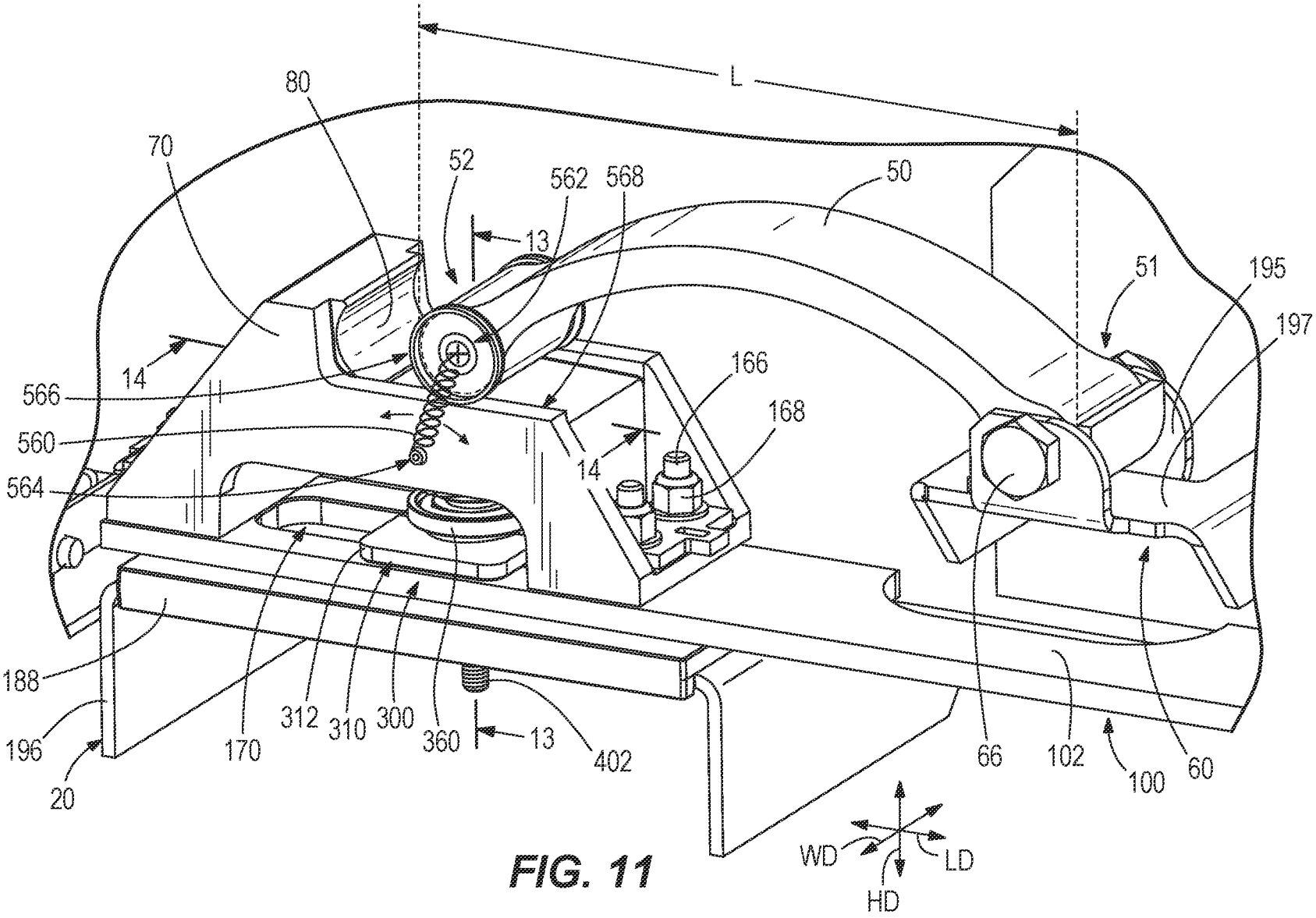
FIG. 11 is a close-up view perspective view depicting another embodiment of a fastener assembly for assembling a fitness machine such as that shown in FIG. 5.
Figure 12:
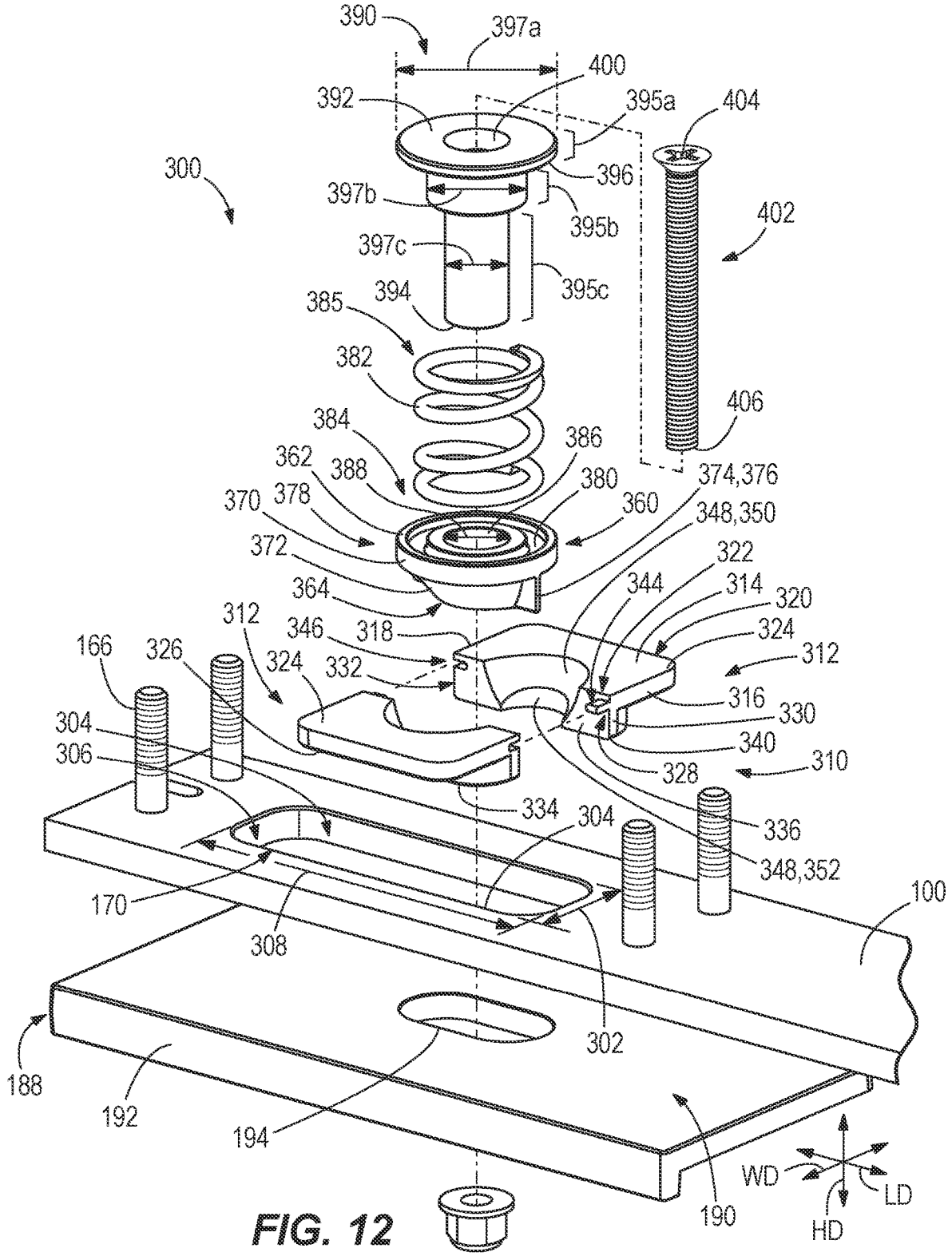
FIG. 12 is a partial exploded view of the fastener assembly of FIG. 11.

FIGS. 11-12 show an alternative fastener assembly 300 for coupling the frame 100 to the base 20, which as discussed above prevents the frame from moving in the width direction WD during operation of the fitness machine. Notably, the fastener assembly 300 may be used with embodiments in which the frame 100 remains moveable in the length direction LD relative to the base 20 and is thus compatible with fitness machines having adjustable shock absorption using the techniques discussed above.

Similar to the discussion above with respect to FIGS. 4-6, the embodiment of FIGS. 11 and 12 provides that the position of the stop wall 80 for an end stop 70 is adjustable by moving the support frame 100 to which the end stop 70 is coupled, specifically in the length direction LD relative to the base 20. Support beams 196 extend inwardly from the base 20, each of which having an opening 198 (FIG. 5) extending therethrough in the height direction HD. A base 188 rests on the top of each support beam 196. Each base 188 includes a plate 190 that rests on the top of the corresponding support beam 196, as well as a wall 192 that extends perpendicularly downwardly from the plate 190. The wall 192 engages with an inside edge of the support beam 196 to prevent rotation of the base 188 relative to the support beam 196. An elongated hole 194 is provided through the plate 190 of each base 188.

With continued reference to FIGS. 11 and 12, the support frame 100 (also referred to simply as a frame 100) is positioned on the bases 188 to thus be supported by the base 20. As discussed above, a slot 170 is defined within the support frame 100, specifically through the side members 102 of the frame 100 and specifically in close proximity to the mounting location of each end stop 70. Therefore, the illustrated example would include 4 slots corresponding to the four end stops 70.

Each slot 170 has a width 302 between sides 304 in the width direction WD and a length 306 between ends 308 in the length direction LD. As will be described in further detail, the fastener assembly 300 is configured to expand in the width direction WD when coupling the support frame 100 to the base 20 to maintain contact between the fastener assembly 300 and both the sides 304 of the slot 170 during operation of the fitness machine.

Figure 13:
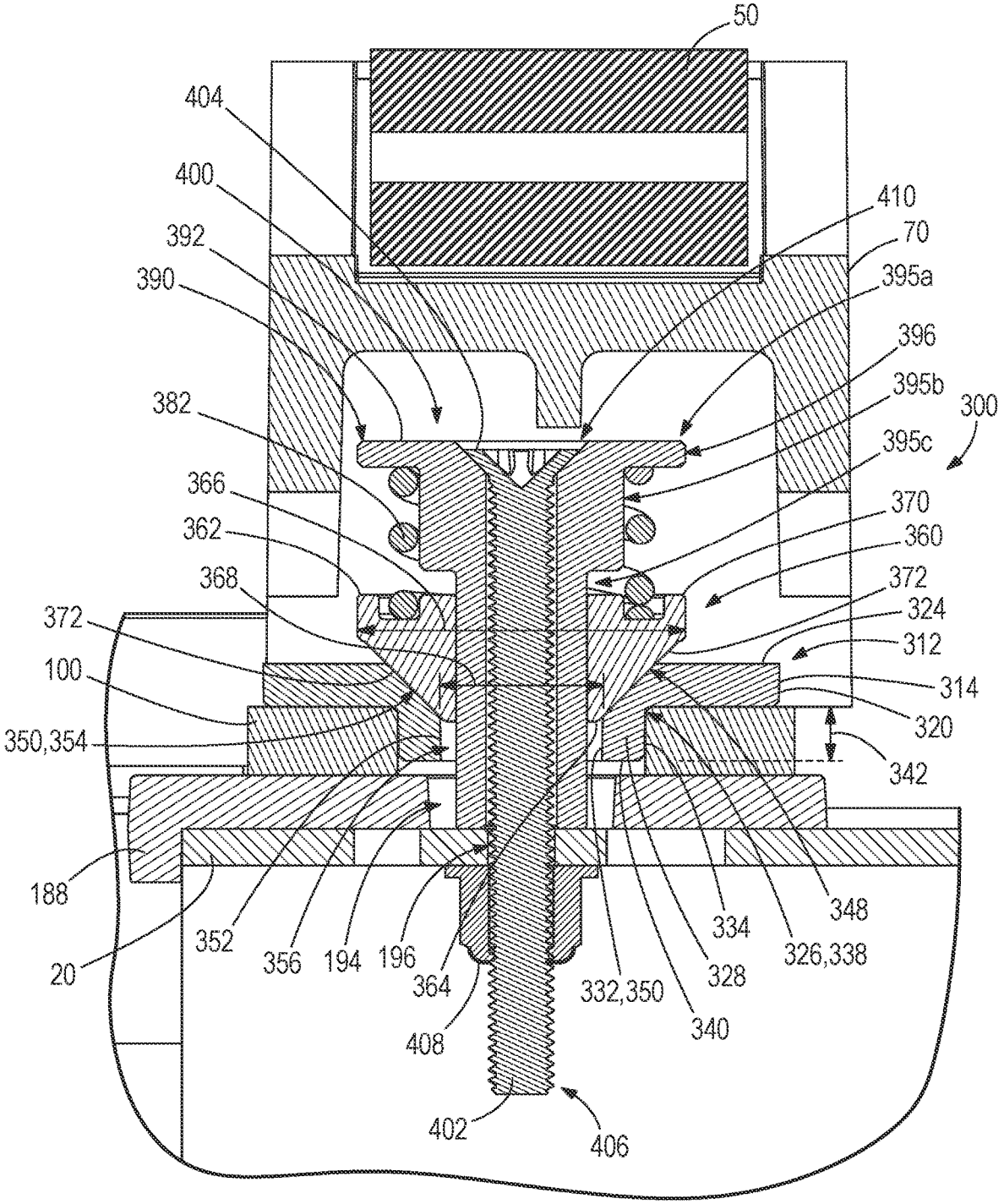
FIG. 13 is a sectional view taken along the line 13-13 in FIG. 12.

Referring to FIGS. 12 and 13, the fastener assembly 300 includes a split bushing 310, also referred to as an expandable bushing, comprising two bodies 312, which in the illustrated example are identical to each other for ease of manufacturing. The two bodies 312 may be made of Delrin® or another material presently known in the art. Each of the bodies 312 has a flange 314 that extends along a length between a first side 316 and a second side 318, along a width between an outer side 320 and an inner side 322, and along a height between a top 324 and a bottom 326. The bottom 326 of the flange 314 is configured to be slidably supported on the top of the support frame 100 as shown in FIG. 13. A leg 328 extends perpendicularly downwardly from the flange 314, particularly at the inner side 322 thereof. The leg 328 extends along a length between a first side 330 and a second side 332, along a width between an outer side 334 and an inner side 336, and along a height between a top 338 and a bottom 340. In the illustrated example, the first side 330 and the second side 332 of the leg 328 are substantially flush with the first side 316 and the second side 318 of the flange 314, respectively. Likewise, the top 338 and the inner side 336 of the leg 328 are flush with the bottom 326 and the inner side 322 of the flange 314, respectively. The outer side 334 of the leg 328 is configured to slidably contact the side 304 of the slot 170 in the support frame 100 as shown in FIG. 13. A height 342 between the bottom 326 of the flange 314 and the bottom 340 in the height direction HD is less than a height of the slot 170 such that the bottom 340 of the leg 328 does not contact the base 188, as also shown in FIG. 13. This allows the split bushing 310 to move in the length direction LD without interference from contacting the base 188.

Each body 312 of the split bushing 310 has a tab 344 and a corresponding opening 346 such that when the inner sides 322 and the inner sides 336 of two bodies 312 are brought together, the opening 346 of one body 312 aligns with the tab 344 of the other body 312 so as to align the two bodies 312 with each other. In certain embodiments, the tabs 344 and the openings 346 of the bodies 312 are configured so as to maintain a separation between the inner sides 322 and the inner sides 336 of the two bodies 312 when the tabs 344 are fully positioned within the openings 346.

Each body 312 further includes an angled face 348 that extends from the top 324 of the flange 314 downwardly and inwardly towards the bottom 340 and the inner side 336 of the leg 328, respectively. In the illustrated example, the angled face 348 includes a first face 350 that transitions to a second face 352 each having a partial-cylinder shape, whereby the first face 350 and the second face 352 each extend at different angles relative to the height direction HD. The first face 350 may be any angle greater than 0° and less than 90° (i.e., relative to the height direction HD). It should be recognized that the angle of the first face 350 determines the magnitude of force acting to expand the split bushing 310. In the illustrated embodiment, the angle of the first face 350 (and likewise the second face 352) is 45° so that the downward retention force from the coil spring 382 (discussed below) is approximately equal to the outward expansion force for the split bushing 310, though other angles are also contemplated. It should be recognized that the present disclosure contemplates other configurations of the angled face 348, including the first face 350 and/or the second face 352 having a variable angle relative to the height direction HD, for example forming a convex or concaved curve. The second faces 352 are shown to be at an angle of 0° relative to the height direction HD.

In the configuration of FIGS. 12 and 13, the two bodies 312 of the split bushing 310 are configured such that when the inner sides 322 and the inner sides 336 are brought together, the first faces 350 form a substantially V-shaped opening 354 therebetween and the second faces 352 form a substantially cylindrically-shaped opening 356 therebetween. The V-shaped opening 354 is particularly formed by the two first faces 350 of the two bodies 312 being cylindrically shaped with axes that are angled relative to each other. In the embodiment shown, the first faces 350 are partial-cylinder shaped with the axes extending perpendicularly to each other. This V-shaped opening 354, formed the two partial-cylinder shapes of the first faces 350, provides for consistent contact between the plunger 360 (discussed below) and the split bushing 310 as the vertical position of one changes relative to the other. It should be recognized that other shapes of the opening 354 and the plunger 360 (discussed below) are also contemplated, including frustums and other shapes.

The fastener assembly 300 further includes a plunger 360 that extends from a top 362 to a bottom 364 in the height direction HD (when assembled within the fitness machine), which in the illustrated embodiment is V-shaped and formed by two intersecting partial-cylinders that extend along axes substantially perpendicularly to each other in the same manner as the V-shaped opening 354 discussed above for the split bushing 310. In particular, an outer surface of the plunger 360 tapers downwardly such that a first diameter 366 at the top 362 of the plunger 360 is greater than a second diameter 368 at the bottom 364. In the illustrated example, a flange 370 is provided at the top 362 of the plunger 360, which extends radially outwardly from an angled face 372 extending from the flange 370 to the bottom 364 of the plunger 360. The angled face 372 is configured to match or generally correspond to the angle of the first face 350 of the two bodies 312 of the split bushing 310, as discussed above and further below. The present disclosure also contemplates other shapes for the plunger 360 to correspond to other designs for the split bushing 310, including frustum or conical shapes.

It should be recognized that the present disclosure also contemplates other configurations in which the plunger 360 does not have a flange 370, but rather has the angled face 372 extending entirely from the bottom 364 to the top 362 of the plunger 360. Likewise, the angle of the angled face 372 (i.e., relative to the height direction HD) may vary from that shown, including having concaved or convex curves.

With continued reference to FIGS. 12 and 13, tabs 374 extend radially outwardly from the angled face 372 at a first side 376 and at a second side 378 of the plunger 360. In the illustrated embodiment, the tabs 374 extend perpendicularly downwardly from the flange 370 to the bottom 364 of the plunger 360. The first side 376 and the second side 378 are substantially flush with the outer diameter of the plunger 360 at the top 362 thereof. The tabs 374 are configured to be positioned between the two bodies 312 of the split bushing 310 in the width direction WD such that operative contact between the two bodies 312 and the tabs 374 prevent the plunger 360 from rotating about an axis parallel to the height direction HD relative to the split bushing 310.

An annular groove 380 is provided within the top 362 of the plunger 360, which extends inwardly toward the bottom 364. The fastener assembly 300 further includes a biasing member, such as a coil spring 382. The coil spring 382 extends from a first end 384 to a second end 385. The annular groove 380 has an inner diameter and an outer diameter configured such that the first end 384 of the coil spring 382 is position therein to thus be axially retained relative to the plunger 360.

An opening 386 extends through the plunger 360 from the top 362 to the bottom 364. The opening 386 has an inner diameter 388 configured so as to accommodate a portion of a cap 390 therein, wherein the cap 390 generally retains the plunger 360 and the coil spring 382 relative to the frame 100 and base 20, as discussed further below. The cap 390 extends from a top 392 to a bottom 394 having a first section 395*a*, a second section 395*b*, and a third section 395*c* therebetween. The first section 395*a* includes a flange 396 having a first diameter 397*a*. The second section 395*b* includes a collar having a second diameter 397*b* that is less than the first diameter 397*a* and the third section 395*c* has a third diameter 397*c* that is less than the second diameter 397*b*.

With continued reference to FIGS. 12 and 13, the third diameter 397*c* of the cap 390 is configured to be positioned within the opening 386 through the plunger 360, in the illustrated example with the opening 386 having a slightly larger diameter than the third diameter 397*c*. The bottom 394 of the plunger 360 is supported on the base 20 and the plunger 360 is moveable in the height direction HD relative to the cap 390 within the third section 395*c* of the cap 390. The second diameter 397*b* of the cap 390 is greater than the diameter of the opening 386, thereby restricting movement of the plunger 360 in the height direction HD past the third section 395*c*. However, the second diameter 397*b* is less than an inner diameter of the coil spring 382, in the present example generally corresponding to the inner diameter of the annular groove 380 in the top 362 of the plunger 360. The first diameter 397*a* at the flange 396 is greater than the inner diameter of the coil spring 382 and thus limits the position of the second end 385 of the coil spring 382 in the height direction HD.

The cap 390 has an opening 400 that extends from the top 392 to the bottom 394 therethrough. The opening 400 is configured to position a fastener 402 therein, such as a bolt or screw. The fastener 402 extends from a head 404 configured to receive a driver (e.g., a Phillips head configured to be driven by a Phillips screwdriver) and a tip 406 opposite the head 404. A diameter of the fastener 402 is greater at the head 404 than the remainder of the fastener 402 down to the tip 406. The fastener 402 is threaded along at least a portion of the outer surface, particularly near the tip 406 such that a nut 408 may threadingly engage with the tip 406 in a conventional manner. In the illustrated example, the opening 400 through the cap 390 is smooth configured to position the fastener 402 therein. A chamfered portion 410 is provided in the top 392 of the cap 390 such that the head 404 of the fastener 402 may be flush or recessed into the cap 390.

In use, the fastener 402 extends through the cap 390, through the opening 198 in the base 20, and into threaded engagement with the nut 408 to attach the cap 390 to the base 20 in the height direction HD (as well as in the width direction WD and length direction LD). The cap 390 also retains the positions of the coil spring 382 and the plunger 360 in the width direction WD and the length direction LD, as discussed above. In other words, the cap 390, the coil spring 382, and the plunger 360 remain coaxially aligned parallel to the height direction HD by virtue of the features described above.

Figure 14:
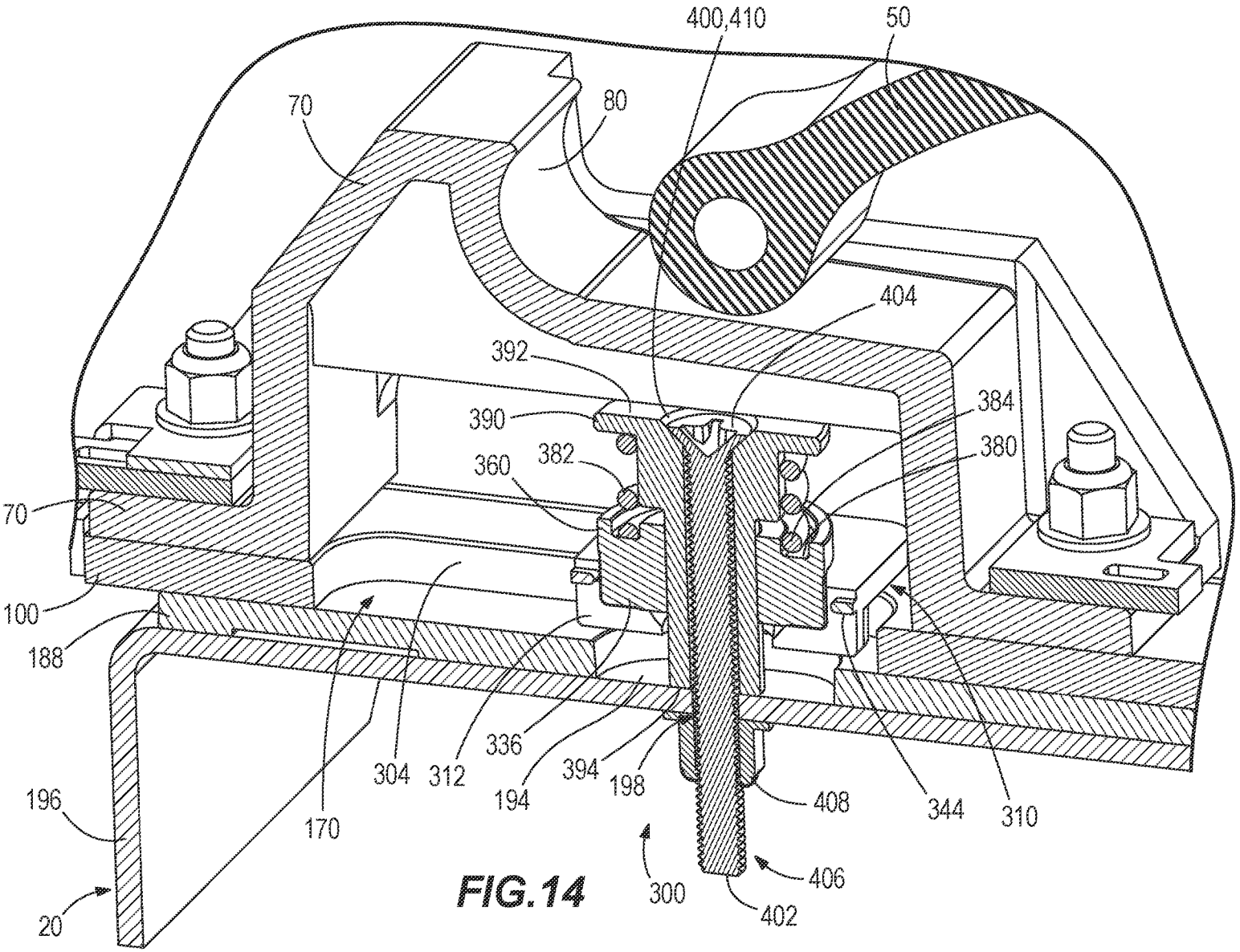
FIG. 14 is a sectional view taken along the line 14-14 in FIG. 12.

When the cap 390 is coupled to the base 20, the fastener assembly 300 is configured such that a distance between the flange 396 of the cap 390 and the base 20 causes the coil spring 382 to be compressed between the flange 396 and the annular groove 380 of the plunger 360, thereby biasing the plunger 360 downwardly away from the flange 396 and towards the split bushing 310. As discussed above, the plunger 360 has an angled face 372 that generally has a V-shape (i.e., from the perspective of the length direction LD) and the first faces 350 of the split bushing 310 form a substantially V-shaped opening 354 generally corresponds to the angel of the angled face 372. As the plunger 360 is biased downwardly by the coil spring 382, two bodies 312 of the split bushing 310 are forced apart, particularly in the width direction WD, by virtue of the operative contact between the angles of the angled face 372 of the plunger 360 and the first faces 350 of the two bodies 312. Another sectional view of the fastener assembly 300 coupling the frame 100 to the base 20 is shown in FIG. 14.

In this manner, the downward force provided by the plunger 360 causes the two bodies 312 to remain in abutting contact with the sides 304 of the slot 170 in the frame 100 in the width direction WD, thereby preventing movement between the fastener assembly 300 and the frame 100 in the width direction WD. This therefore prevents any noises that may be caused by such movement between the frame 100 and the base 20 to which it is coupled via the fastener assembly 300, providing an improved user experience and reducing wear from lateral movement of the components. This also provides that the plunger 360 and the two bodies 312 of the split bushing 310 remain centered above an axis parallel to the height direction HD by virtue of the angled faces being V-shaped. It should be recognized that the fastener assembly 300 also therefore prevents movement of the frame 100 relative to the base 20 in the height direction HD by virtue of the angled face 372 of the plunger 360 providing a downward force on the first faces 350 of the split bushing 310. However, the frame 100 remains capable of being moved in the length direction LD relative to the base 20, which as discussed above allows for adjusting the shock absorption provided by the shock absorption system.

Another advantage of the presently disclosed fitness machine is that a zero clearance is maintained between all the components even after split bushing 310 begins to wear with repeated cycling of the shock absorption system. This extends the life of the product by not having to replace bearings, or not having to replace them as early, while also reducing the cost of ownership.

Through further experimentation and development, and with reference to FIG. 6, the present inventors have identified another cause of a user's engagement with the machine generating undesirable noise, in this case due to contact with the leaf spring 50. This contact may be between the resilient body (e.g., leaf spring 50) and the underside of the mobile portion 42 (e.g., a treadmill deck), and/or between the leaf spring 50 and the end stop 70 that limits the body length L of the leaf spring 50 in the manner discussed above. This contact may be a rubbing or sliding type of contact caused by friction due to relative movement in the length direction LD (or width direction WD) between the leaf spring 50 and the mobile portion 42 and/or between the leaf spring 50 and the end stop 70. This contact may also or alternatively be caused by impact when there is relative movement in the height direction HD between the leaf spring 50 and the mobile portion 42 of the fitness machine. By way of example the treadmill deck may jump during the gait cycle of the user such that the underside is not in continuous contact with the leaf spring 50. Likewise, contact-type noise may be generated when the second end 52 of the leaf spring 50 repeatedly contacts the wall 80 of the end stop 70 in the length direction LD.

Through further experimentation and development, the present inventors have found that these noises are effectively abated by incorporating one or more cushions that operatively contact the leaf spring 50 so as to reduce the noises generated from contact with the leaf spring 50 during operation of the machine.

Figure 15:
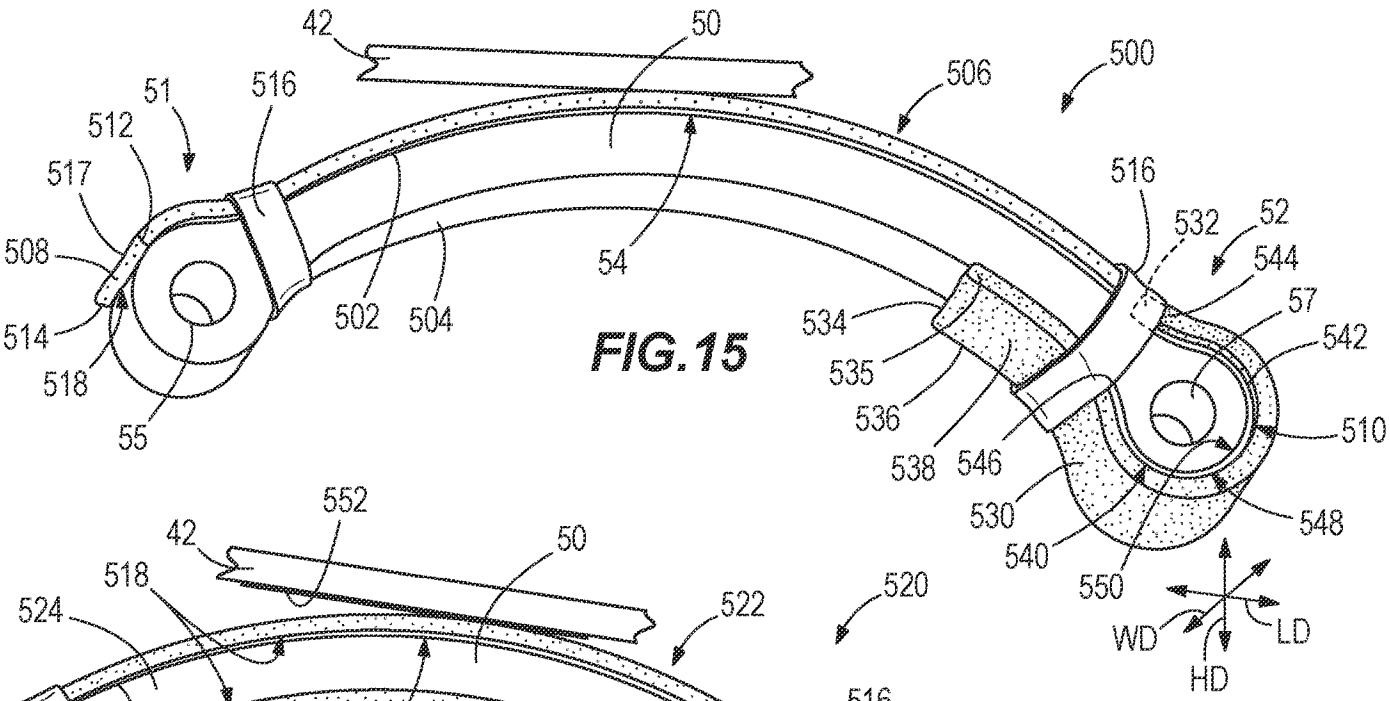
FIG. 15 is a perspective view of an embodiment of a leaf spring assembly according to the present disclosure useable in a fitness machine such as shown in FIG. 5.

FIG. 15 illustrates a first embodiment of a leaf spring assembly 500 for reducing noise generated from contact with a resilient body during operation of a fitness machine, such a leaf spring 50 as discussed above. The leaf spring assembly 500 includes a leaf spring 50 similar to those discussed above, which extends from a first end 51 to a second end 52 with a vertex 54 positioned approximately at a midpoint therebetween. The leaf spring 50 has an upper surface 502 and a lower surface 504. The leaf spring assembly 500 includes a first cushion 506 that is positioned between the upper surface 502 of the leaf spring 50 and the mobile portion 42, which is shown in part superimposed the leaf spring 50 for reference.

The first cushion 506 extends along a length between a first end 508 and a second end 510, along a width between a third end 512 and a fourth end 514, and has a depth between an outer surface 517 and an inner surface 518. In the illustrated example, the length between the first end 508 and a second end 510 generally corresponds to a length of the arc of the upper surface 502 of the leaf spring 50 between the first end 51 and the second end 52 thereof. Likewise, the width of the first cushion 506 between the third end 512 and the fourth end 514 generally corresponds to a width of the leaf spring 50 in the width direction WD. The first cushion 506 may be coupled to the leaf spring 50 in a variety of manners, including integral formation, adhesives, or other techniques known in the art. In the illustrated embodiment, bands 516 are provided in one or more locations between the first end 51 and the second end 52 of the leaf spring 50, which cinch, tie, or clamp the first cushion 506 and the leaf spring 50 to prevent separation thereof. The bands 516 may be zip-ties, rubber bands, metal or synthetic straps that are crimped or otherwise tied in place, or other mechanisms known in the art. In certain embodiments, the elastic nature of the leaf spring 50 permits the bands 516 to partially indent the leaf spring 50 (hidden beneath the band 516), thereby preventing movement of the bands 516 along the length of the leaf spring 50 in use. The present disclosure also contemplates configurations in which the bands 516 extend through openings through the width of the leaf spring 50, the use of notches in the upper surface 502 and/or a lower surface 504 of the leaf spring 50, or other mechanisms for fixing the bands 516 relative to the leaf spring 50 when in use, particularly in the length direction LD.

The first cushion 506 may comprise many different types of materials, such as nylon webbing, felt, plastic (including rigid or flexible), or other materials known in the art. The present inventors have identified that the first cushion 506 in certain fitness machines principally reduces noise by reducing the friction between the mobile portion 42 and the leaf spring 50 in the length direction LD. Thus, while not required, the first cushion 506 is advantageously comprised of a different material than the leaf spring 50. In these cases, the first cushion 506 is selected to be robust for this sliding or rubbing type contact, which the present inventors have identified nylon webbing to by particularly suited to handle in a cost-effective manner.

Figure 16:
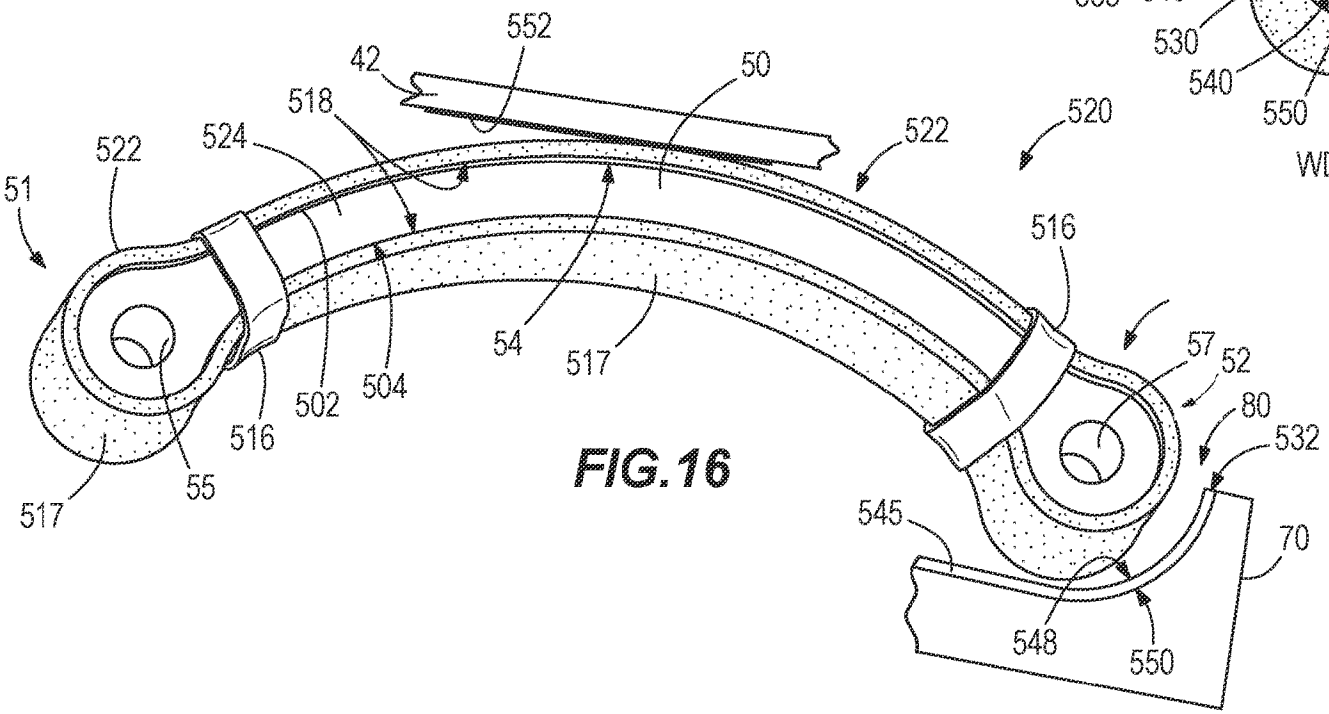
FIG. 16 is a perspective view of another embodiment of a leaf spring assembly according to the present disclosure useable in a fitness machine such as shown in FIG. 5.

FIG. 16 shows an alternate embodiment of leaf spring assembly 520 in which the first cushion 522 extends entirely around the leaf spring 50. In other words, the first cushion 522 completely encircles the leaf spring 50 (though not necessarily the sides 524 of the leaf spring 50 across which the leaf spring 50 extends in the width direction WD. The first cushion 522 may otherwise be the same or similar to the first cushion 506 discussed above. The present inventors have identified that the encircling design of the first cushion 522 of FIG. 16 advantageously avoids the need to align the first cushion 522 between the first end 51 and the second end 52 of the leaf spring 50, and also avoids any concerns with the first cushion 522 moving in the length direction LD relative to the leaf spring 50.

As discussed above, the present inventors have further developed solutions for abating noise caused by contact between the second end 52 of the leaf spring 50 and the end stop 70. In particular, further discussion will be provided for a second cushion 530 that provides this noise abatement. It should be recognized that the second cushion 530 may be used in addition to, or as an alternative to the first cushion 506 or the first cushion 522 discussed above. FIG. 15 shows an embodiment of the second cushion 530 that is configured to reduce or eliminate noise generated by contact between the second end 52 of the leaf spring 50 and the end stop 70. The second cushion 530 may comprise a second material distinct from the first material of the first cushion 506, and/or be distinct from a third material comprising the leaf spring 50. Since the present inventors have found that the noise generated by contact at the second end 52 of the leaf spring 50 is principally caused by impact or shock, rather than sliding or friction, particularly advantageous material choices for the second cushion 530 include felt, foam, or other compressible materials. In one example, felt of 95% wool (SAE standard F1 felt) was identified to work particularly well in cushioning the operative contact between the second end 52 of the leaf spring 50 and the wall 80 of the end stop 70, thereby effectively eliminating noise.

The second cushion 530 extends along a length between a first end 532 and a second end 534, along a width between a third end 535 and a fourth end 536, and has a depth between an outer surface 538 and an inner surface 540. The second cushion 530 overlays a portion of the leaf spring 50, specifically wrapping around the second end 52 of the leaf spring 50. The second cushion 530 may be coupled to the leaf spring 50, including indirectly via the first cushion 506, in the same or a similar manner as the first cushion 506. In the illustrated example of FIG. 15, the second cushion 530 also partially overlaps with the first cushion 506 such that the same band 516 not only secures both the first cushion 506 and the second cushion 530, but also both the first end 532 and the second end 534 of the second cushion 530.

While the present embodiment shows the second cushion 530 as a separate element from the first cushion 506, it should be recognized that these materials may also be combined as a single material having both friction reducing and shock reducing capabilities. The second cushion 530 may also be provided on only a portion of the first cushion 506 that aligns with the second end 52 of the leaf spring 50, whether being integrally formed with or subsequently coupled to the first cushion 506.

The leaf spring assembly 500 of FIG. 15 also includes an optional plate 542 that can be sandwiched between the leaf spring 50 and the first cushion 506, the first cushion 522, and/or the second cushion 530. The plate 542 extends along a length from a first end 544 to a second end 546, along a width (illustrated here to be substantially similar to the width of the leaf spring 50), and has a thickness between an outer surface 548 and an inner surface 550. The plate 542 is configured to reduce the friction between the leaf spring 50 and the first cushion 506, the first cushion 522, and/or the second cushion 530. The plate 542 may comprise a plastic material, a synthetic webbing material, or a metal alloy (e.g., steel, aluminum), by way of example. In certain configurations, the inner surface 550 is adhered to or integrally formed with the leaf spring 50 (e.g., via injection molding) to be coupled thereto. However, other techniques for coupling the plate 542 to the second end 52 of the leaf spring 50 are also contemplated, including being held in position by virtue of the band 516 and/or being sandwiched between the leaf spring 50 and the first cushion 506, the first cushion 522, and/or the second cushion 530.

In certain embodiments, the plate 542 may be used without the second cushion 530 being on the leaf spring 50. In one example, a reduced friction of the plate 542 is well suited to directly contact a second cushion 530 on the end stop 70 (i.e., replacing the element shown as 545 in FIG. 16). The plate 542 (again, without the second cushion 530 covering it on the leaf spring 50) may directly contact the plate 545 on the end stop 70 as shown in FIG. 16. It should be recognized that other combinations of plates and cushions are also contemplated by the present disclosure.

As shown in FIG. 16, a similar plate 545 may also or alternatively be provided between the leaf spring assembly 520 and the end stop 70 so as to reduce friction therebetween. In other examples, another cushion such as the first cushion 506, the first cushion 522, and/or the second cushion 530 may be coupled to the end stop 70 (in addition to, or as an alternative to being coupled to the leaf spring 50) to provide the desired effect. For example, the first cushion 506 may be coupled to the leaf spring 50 with the second cushion coupled to the end stop 70.

In certain examples of fitness machines, such as the treadmill of FIG. 2, the present inventors have found it sufficient for the first cushion for reducing friction type contact between the leaf spring 50 and the mobile portion 42 (the deck) to overlay only the uppermost portion of the leaf spring 50, such as the 20%, 50%, or 75% of the length of the leaf spring 50. Likewise, in certain configurations only the end wall 80 of the end stop 70 need be cushioned via the second cushion 530. In other cases, it is advantageous to cover the entire portion of the end stop 70 in which contact is made with the second end 52 of the leaf spring 50 so as to avoid the movement the leaf spring 50 removing the second cushion 530 after extensive use.

Returning to FIG. 15, the present inventors have further identified that the friction type contact and the noises therefrom can be reduced or eliminated by treating the upper surface 502 of the leaf spring 50 with a friction reducing material. Similarly, the leaf spring 50 can be formed or fabricated such that the upper surface 502 comprises a separate material than the remainder of the leaf spring 50, such 2-shot injection molding that results in the upper surface 502 comprising Delrin® or another low friction material known in the art.

In addition, or in the alternative, such a friction reducing treatment or material may be applied to the underside of the mobile portion 42 to provide the same effect. The embodiment of FIG. 16 shows such a configuration in which at least a portion of the underside of the mobile portion 42 comprises Delrin® or another friction material, which is advantageous to incorporate even with the use a first cushion 506 or a first cushion 522 on the leaf spring 50 to reduce friction and thus, noise. The example shown is a plate 552 that is positioned over the leaf spring 50 in the height direction HD, whereby the plate is sized in the length direction LD and the width direction WD to accommodate all movement between the mobile portion 42 and the leaf spring 50. In other words, the plate 552 is configured such that the leaf spring 50 only touches the plate 552 during operation of the fitness machine, rather than the mobile portion 42 itself. The plate 552 may be coupled to the underside of the mobile portion 42 via integral formation, fasteners, or adhesives, by way of example.

Certain embodiments further provide for preventing the second end 52 of the leaf spring 50 from moving in the height direction HD. One such embodiment was discussed above and shown in FIG. 3, whereby a second pin 82 is vertically confined within a slot 74 in the end stop 70. Another embodiment is shown in FIG. 11. In this embodiment, a coil spring 560 is coupled at a first end 562 to the second pin 82 and a second end 564 of the coil spring 564 is coupled to the side of the end stop 70, such as via a screw or another fastener. The coil spring 560 provides a downward, tensile force in the height direction HD to prevent the second end 52 of the leaf spring 50 from moving in the height direction HD. It should be recognized that other mechanisms may be used to provide this downward force, including gas springs or elastomeric bands, by way of example. In certain further embodiments, rollers 566 are also coupled to the second end 52 of the leaf spring 50, which allow the second end 52 of the leaf spring 50 to roll along rails 568 of the end stop 70.

In this manner, the presently disclosed cushioning concepts and the various combinations thereof provide for reduced noise generation due to contact with the resilient body providing shock absorption for a fitness machine, whether from friction or impact.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A fitness machine operable by a user, the fitness machine comprising:

a base that extends in a length direction, a width direction, and a height direction that are perpendicular to each other;

a mobile portion configured to support the user during operation of the fitness machine;

a resilient body configured to provide a resistance against the mobile portion moving towards the base in the height direction;

a frame moveable in the length direction relative to the base to adjust the resistance provided by the resilient body; and a fastener assembly that moveably couples the frame to the base, wherein the fastener assembly is configured to expand in the width direction to prevent the frame from moving in the width direction relative to the base during operation of the fitness machine.

2. The fitness machine according to claim 1, wherein a bushing of the fastener assembly is configured to slide within a slot that extends in the length direction relative to the base when coupling the frame to the base such that the frame is moveable in the length direction.

3. The fitness machine according to claim 2, wherein the slot extends through the frame.

4. The fitness machine according to claim 1, wherein the fastener assembly includes an expandable bushing that expands in the width direction within the slot that extends in the length direction relative to the base to prevent the frame from moving in the width direction relative to the base.

5. The fitness machine according to claim 4, wherein the fastener assembly includes a plunger having a first angled face, and wherein the expandable bushing has a second angled face corresponding to the first angled face of the plunger such that operative contact between the first angled face and the second angled face centers the plunger and the expandable bushing about an axis parallel to the height direction.

6. The fitness machine according to claim 1, wherein the fastener assembly includes a plunger and a bushing, wherein the plunger has an angled face that when operatively contacting the bushing causes the bushing to move in the width direction to thereby cause the fastener assembly to expand in the width direction.

7. The fitness machine according to claim 6, wherein the fastener assembly further comprises a biasing member that causes the plunger to operatively contact the bushing such that the fastener assembly expands in the width direction.

8. The fitness machine according to claim 1, wherein the fastener assembly is also configured to prevent the frame from moving in the height direction relative to the base during operation of the fitness machine.

9. The fitness machine according to claim 1, wherein the frame is supported by the base.

10. The fitness machine according to claim 1, wherein the resilient body is supported by the frame and moveable therewith.

11. A fitness machine operable by a user, the fitness machine comprising:

a base that extends in a length direction, a width direction, and a height direction that are perpendicular to each other;

a mobile portion configured to support the user during operation of the fitness machine;

a resilient body that extends along a body length from a first end to a second end and supports the mobile portion at a position therebetween, wherein the resilient body is configured to provide a resistance against the mobile portion moving towards the base in the height direction, wherein the body length of the resilient body changes in the length direction relative to the base when providing the resistance during operation of the fitness machine; and a cushion that operatively contacts the resilient body so as to reduce noise generated from contact with the resilient body during operation of the fitness machine.

12. The fitness machine according to claim 11, wherein the resilient body comprises a first material, the cushion comprises a second material, and the resilient body and the cushion are integrally formed together.

13. The fitness machine according to claim 12, wherein the resilient body comprises urethane, the cushion comprises plastic.

14. The fitness machine according to claim 11, further comprising an end stop operable to prevent the body length of the resilient body from increasing beyond a set maximum, the end stop being moveable to adjust the set maximum for the body length of the resilient body, wherein the cushion is positioned between the resilient body and the end stop to reduce the noise generated from contact therebetween during operation of the fitness machine.

15. The fitness machine according to claim 14, wherein the cushion comprises foam.

16. The fitness machine according to claim 14, wherein the cushion is a first cushion, further comprising a second cushion positioned between the resilient body and the mobile portion to reduce the noise generated from contact therebetween during operation of the fitness machine.

17. The fitness machine according to claim 11, wherein the cushion is positioned between the resilient body and the mobile portion to reduce the noise generated from contact therebetween during operation of the fitness machine.

18. The fitness machine according to claim 11, wherein the cushion is coupled to the resilient body.

19. The fitness machine according to claim 11, wherein the cushion comprises a synthetic web that covers at least a portion of the resilient body.

20. A fitness machine operable by a user, the fitness machine comprising:

a base that extends in a length direction, a width direction, and a height direction that are perpendicular to each other;

a mobile portion configured to support the user during operation of the fitness machine;

a resilient body configured to provide a resistance against the mobile portion moving towards the base in the height direction, wherein a body length of the resilient body changes in the length direction relative to the base when providing the resistance during operation of the fitness machine;

a cushion that operatively contacts the resilient body so as to reduce noise generated from contact with the resilient body during operation of the fitness machine;

a frame moveable in the length direction relative to the base to adjust the resistance provided by the resilient body; and a fastener assembly that moveably couples the frame to the base, wherein the fastener assembly is configured to expand in the width direction to prevent the frame from moving in the width direction relative to the base during operation of the fitness machine.

* * * * *